US009316954B2

(12) United States Patent
Yoshida et al.

(10) Patent No.: US 9,316,954 B2
(45) Date of Patent: Apr. 19, 2016

(54) IMAGE FORMING APPARATUS

(71) Applicants: Ken Yoshida, Kanagawa (JP); Keiko Matsumoto, Kanagawa (JP); Tomohide Takenaka, Kanagawa (JP); Daisuke Ito, Kanagawa (JP); Daisuke Takahashi, Kanagawa (JP); Masahiro Katoh, Kanagawa (JP); Yoichi Sakurai, Kanagawa (JP)

(72) Inventors: Ken Yoshida, Kanagawa (JP); Keiko Matsumoto, Kanagawa (JP); Tomohide Takenaka, Kanagawa (JP); Daisuke Ito, Kanagawa (JP); Daisuke Takahashi, Kanagawa (JP); Masahiro Katoh, Kanagawa (JP); Yoichi Sakurai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 47 days.

(21) Appl. No.: 14/036,194

(22) Filed: Sep. 25, 2013

(65) Prior Publication Data

US 2014/0086605 A1 Mar. 27, 2014

(30) Foreign Application Priority Data

Sep. 27, 2012 (JP) ..... 2012-214624
Apr. 18, 2013 (JP) ..... 2013-087537
Apr. 26, 2013 (JP) ..... 2013-093247

(51) Int. Cl.
*G03G 15/23* (2006.01)
*G03G 15/16* (2006.01)
*G03G 15/00* (2006.01)

(52) U.S. Cl.
CPC ..... *G03G 15/16* (2013.01); *G03G 15/234* (2013.01); *G03G 15/5025* (2013.01)

(58) Field of Classification Search
CPC ..... G06F 3/1255
USPC ..... 399/82, 85
See application file for complete search history.

(56) References Cited

U.S. PATENT DOCUMENTS 6,526,251 B1 * 2/2003 Otsuka et al. ..... 399/313
2004/0136760 A1 7/2004 Yoshida et al.

(Continued)

FOREIGN PATENT DOCUMENTS

JP 8-248787 9/1996
JP 2001-312154 11/2001

(Continued)

OTHER PUBLICATIONS

U.S. Appl. No. 13/945,365, filed Jul. 18, 2013.

*Primary Examiner* — David Gray
*Assistant Examiner* — Sevan A Aydin
(74) *Attorney, Agent, or Firm* — Oblon, McClelland, Maier & Neustadt, L.L.P

(57) ABSTRACT

An image forming apparatus includes an image carrier, a transfer unit, and a control unit. The image carrier has a surface to bear a toner image thereon. The transfer unit has a transfer member to transfer the toner image onto a recording sheet conveyed in a conveyance direction for trailing-end borderless image formation and duplex image formation. The transfer unit is configured to form the toner image on the recording sheet without forming a margin at a trailing end of the recording sheet in the conveyance sheet in the trailing-end borderless image formation. The transfer unit is configured to form the toner image on front and back faces of the recording sheet in the duplex image formation. When a width of the toner image formed in a borderless image area of the recording sheet in the trailing-end borderless image formation is smaller in a direction perpendicular to the conveyance direction than a threshold value, the control unit permits the duplex image formation. When the width is the threshold value or greater, the control unit prohibits the duplex image formation.

19 Claims, 30 Drawing Sheets

(56) References Cited

U.S. PATENT DOCUMENTS

| | | | | |
|---|---|---|---|---|
| 2005/0013636 | A1 | 1/2005 | Sawai et al. | |
| 2005/0099644 | A1* | 5/2005 | Nomoto et al. | 358/1.12 |
| 2005/0147424 | A1 | 7/2005 | Kato et al. | |
| 2005/0254853 | A1 | 11/2005 | Yoshida | |
| 2007/0092282 | A1* | 4/2007 | Takenoshita | G03G 15/5016 399/81 |
| 2007/0127960 | A1 | 6/2007 | Yoshida | |
| 2007/0134014 | A1 | 6/2007 | Kato et al. | |
| 2007/0280748 | A1 | 12/2007 | Yoshida | |
| 2008/0037038 | A1* | 2/2008 | Arai | 358/1.2 |
| 2008/0088883 | A1 | 4/2008 | Yoshida | |
| 2008/0279589 | A1 | 11/2008 | Muto et al. | |
| 2009/0016784 | A1 | 1/2009 | Yoshida | |
| 2009/0196661 | A1 | 8/2009 | Yoshida | |
| 2010/0080631 | A1 | 4/2010 | Ogiyama et al. | |
| 2010/0266300 | A1 | 10/2010 | Yoshida | |
| 2011/0091224 | A1 | 4/2011 | Takenaka | |
| 2011/0103810 | A1 | 5/2011 | Yoshida | |
| 2011/0206394 | A1 | 8/2011 | Takenaka | |
| 2011/0228355 | A1 | 9/2011 | Morita et al. | |
| 2011/0249992 | A1 | 10/2011 | Yoshida | |
| 2012/0008991 | A1 | 1/2012 | Shimizu | |
| 2012/0230706 | A1 | 9/2012 | Yoshida | |
| 2012/0321357 | A1 | 12/2012 | Ogiyama et al. | |
| 2013/0028619 | A1 | 1/2013 | Terao et al. | |
| 2013/0028620 | A1 | 1/2013 | Terao et al. | |
| 2013/0077984 | A1 | 3/2013 | Yoshida | |
| 2013/0101303 | A1 | 4/2013 | Kasai et al. | |

FOREIGN PATENT DOCUMENTS

| | | |
|---|---|---|
| JP | 2004-045457 | 2/2004 |
| JP | 2006-220991 | 8/2006 |
| JP | 2006-308816 | 11/2006 |
| JP | 2010-217742 | 9/2010 |
| JP | 2012-018369 | 1/2012 |

* cited by examiner

FIG. 12

| | | THICKNESS (TH) OF RECORDING SHEET [g/m^2] | | |
|---|---|---|---|---|
| | | TH < 120gsm | 120gsm ≤ TH < 200gsm | 200gsm ≤ TH < 260gsm |
| PIXEL AREA (PA) | PA < 100% | A (20%) | C1 (40%) | C2 (60%) |
| | 60% ≤ PA < 100% | B1 (25%) | D1 (45%) | D4 (65%) |
| | 30% ≤ PA < 60% | B2 (30%) | D2 (50%) | D5 (70%) |
| | PA < 30% | B3 (35%) | D3 (55%) | D6 (75%) |

IMAGE FORMING APPARATUS

CROSS-REFERENCE TO RELATED APPLICATIONS

This patent application is based on and claims priority pursuant to 35 U.S.C. §119 to Japanese Patent Application Nos. 2012-214624, filed on Sep. 27, 2012, 2013-087537, filed on Apr. 18, 2013, and 2013-093247, filed on Apr. 26, 2013, in the Japan Patent Office, the entire disclosure of each of which is hereby incorporated by reference herein.

BACKGROUND

1. Technical Field

This disclosure relates to an image forming apparatus, and more specifically to an image forming apparatus capable of performing borderless image formation and duplex image formation and operation control of the image forming apparatus.

2. Description of the Related Art

Image forming apparatuses are used as printers, facsimile machines, copiers, plotters, or multi-functional devices having, e.g., two or more of the foregoing capabilities. In such an image forming apparatus, a toner adheres to a front face of a transfer member for transferring an image onto a transfer sheet or the like, particularly to a secondary transfer member of an intermediate transfer type due to contact with a toner pattern or toner dirt on an intermediate transfer member in some cases. For this reason, for example, JP-2001-312154-A proposes a technique for providing a cleaning mechanism for removing the adhering toner. In particular, in a case in which an image of a toner pattern is formed in an inter-sheet area to control toner density, the toner adhesion to the front face of the intermediate transfer member is remarkable. Therefore, the cleaning mechanism is indispensable.

Typically, brush cleaning or blade cleaning is used as the cleaning mechanism. In some cases, however, a roller member having a relatively small diameter is used for the secondary transfer member in order to enhance separation performance of a sheet. Such a configuration may hamper cleaning of a front face of a thin roller-shaped member. As a result, the toner adhering to the secondary transfer member may stick to a back face of a conveyed sheet, thus making the back face of the sheet dirty. One approach to enhance cleaning performance includes a technique for coating the front face of the secondary transfer member with a material having an excellent mold release characteristic or applying a lubricant onto the front face. However, such approach causes an increase in cost and size of the apparatus.

For example, JP-H08-248787-A discloses, as an approach to prevent the foregoing, the technique for applying a bias having a reverse polarity to a transfer bias to prevent a toner from adhering to a transfer member in order to inhibit a back face of a sheet from becoming dirty. Moreover, JP-2006-308816-A discloses the technique for returning a toner once adhered to a secondary transfer member to an intermediate transfer body through a bias, thereby carrying out cleaning, for example. However, these techniques are insufficient for preventing the toner adhesion from being caused by the toner pattern of which image is formed in the inter-sheet area. Therefore, JP-2012-018369-A discloses the technique for separating a secondary transfer member from an intermediate transfer body in an inter-sheet area when forming an image of a toner pattern in the inter-sheet area, as an approach for forming the image of the toner pattern in the inter-sheet area, being utilized for density detection control in continuous image formation or prevention of deterioration in the image through replacement of a toner, and inhibiting the secondary transfer member from being contaminated with the toner without providing an expensive cleaning mechanism in the secondary transfer member, for example.

On the other hand, in recent years, a demand for borderless image formation has been increased. Referring to the borderless image formation according to the related art, there has been carried out a work for forming an image on a sheet of a size larger than a standard size and then removing a margin part. In order to simplify the work, however, the necessity for the borderless image formation has been increased. The technique for carrying out the borderless image formation includes a technique for forming an image to reach edges of a sheet and conveying the sheet with high positional precision, the technique disclosed in JP-2006-220991-A for detecting a sheet conveyance position to adjust an image formation area, for example, and the technique disclosed in JP-2004-045457-A for forming an image framing out from a sheet on the assumption that a conveyance position varies to some extent, for example.

Such an image forming apparatus described in JP-2004-045457-A or the like is capable of performing a bordered print mode for forming an image on a sheet so as to have a margin on a border around a whole periphery of a sheet and a borderless print mode for forming an image so as to have no margin on the border around the whole periphery of the sheet or any border.

In the techniques, however, a unit for controlling sheet conveyance with high precision increases a cost and a size of an apparatus, and it may be difficult to detect a sheet conveyance position with high precision in a high-speed machine of a high conveyance speed. In the case in which the image is formed framing out from the sheet, moreover, the front face of the secondary transfer member may be contaminated with the stray toner, causing contamination of the back face or a cut end. In order to prevent such a problem, for example, cleaning is performed on the front face of the secondary transfer member. However, as describe above, it is technically difficult to clean the secondary transfer member by the cleaning member. enhancing the performance may cause an increase in the cost and the size of the apparatus.

Furthermore, if the borderless image formation is performed in a state in which a leading end part of a sheet has no border, the sheet may be wound around a fixing member in an electrophotographic apparatus. For this reason, a margin is generally provided in the leading end part of the sheet. If duplex image formation is carried out when an image is formed with a trailing end of the sheet having no border, however, the trailing end on a front face side acts as a leading end on a back face side and enters the fixing member in a state in which the leading end of the sheet has a toner. Also in this case, consequently, the sheet may be wound around the fixing member, thus hampering execution of the borderless image formation and the duplex image formation at the same time.

For the image forming apparatus capable of executing the bordered print mode and the borderless print mode like that described in JP-2004-045457-A, generally, the bordered print mode is selected as initial setting. In the case in which the borderless print mode is executed, an operator selects the borderless print mode through a touch panel or the like and carries out switching from the bordered print mode to the borderless print mode. For this reason, even if there are needs for always performing the borderless printing for a sheet of a specific one of various types, the operator selects the borderless print mode at each time, thus increasing the operation burden of the operator.

BRIEF SUMMARY

In at least one exemplary embodiment of this disclosure, there is provided an image forming apparatus including an image carrier, a transfer unit, and a control unit. The image carrier has a surface to bear a toner image thereon. The transfer unit has a transfer member to transfer the toner image onto a recording sheet conveyed in a conveyance direction for trailing-end borderless image formation and duplex image formation. The transfer unit is configured to form the toner image on the recording sheet without forming a margin at a trailing end of the recording sheet in the conveyance sheet in the trailing-end borderless image formation. The transfer unit is configured to form the toner image on front and back faces of the recording sheet in the duplex image formation. When a width of the toner image formed in a borderless image area of the recording sheet in the trailing-end borderless image formation is smaller in a direction perpendicular to the conveyance direction than a threshold value, the control unit permits the duplex image formation. When the width is the threshold value or greater, the control unit prohibits the duplex image formation.

In at least one exemplary embodiment of this disclosure, there is provided an image forming apparatus including an image forming device, and a print condition setting unit. The image forming device forms an image on a recording sheet in accordance with a preset print condition to perform a bordered print mode and a borderless print mode. The image forming device is configured to form the toner image in the bordered print mode so that a periphery of the recording sheet is surrounded by a margin. The image forming device is configured to form the toner image up to an end of the recording sheet in the borderless print mode so that at least a portion of the periphery of the recording sheet has no margin. The print condition setting unit sets, as the preset print condition, whether the bordered print mode or the borderless print mode is to be performed in accordance with a type of the recording sheet.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 12 is a table of predetermined values to be used in the fourth embodiment of the present disclosure;

Figure 1:
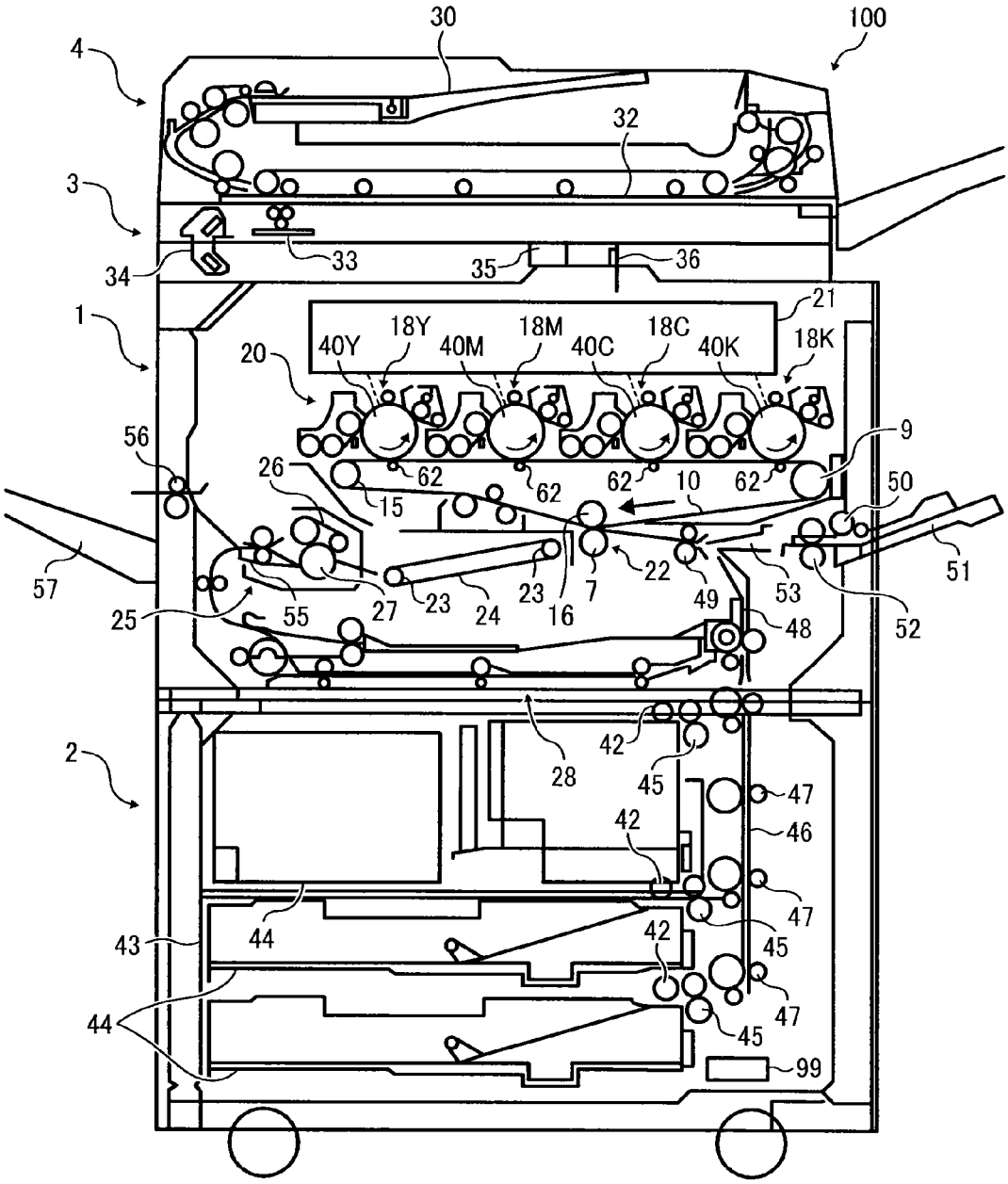
FIG. 1 is a schematic view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

FIG. 1 is a schematic view of an image forming apparatus 100 according to at least one exemplary embodiment of the present disclosure.

The image forming apparatus 100 illustrated as a color copier in FIG. 1 is a tandem-type electrophotographic apparatus having an intermediate transfer belt 10, and has a sheet feed table 2 in a lowermost part thereof, an apparatus body 1 above the sheet feed table 2, and a scanner 3 and an auto document feeder (ADF) 4 above the apparatus body 1.

The image forming apparatus 100 has a transfer device 20 at a substantially middle part of the apparatus body 1. The transfer device 20 is an endless belt serving as an image carrier. The intermediate transfer belt 10 is extended taut by a driving roller 9 and respective driven rollers 15 and 16. The driving roller 9 is rotated and driven by a driving unit to run in a clockwise direction in FIG. 1. A cleaning device is provided at a left side (in FIG. 5) of the driven roller 15 to remove toner remaining on a surface of the intermediate transfer belt 10 after image transfer. Thus, the intermediate transfer belt 10 is prepared for the next image formation performed by the transfer device 20.

Figure 2:
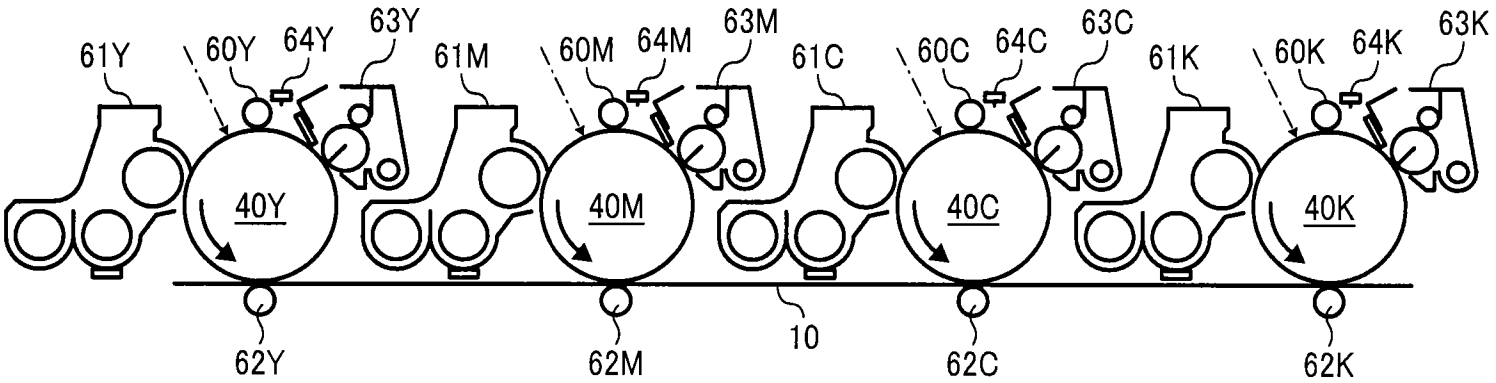
FIG. 2 is a schematic view of an image forming unit of an image forming apparatus according to at least one exemplary embodiment of the present disclosure.

Drum-shaped photoconductors 40Y, 40M, 40C and 40K constituting four image forming units of yellow, magenta, cyan and black are arranged side by side in a moving direction thereof above a linear part of the intermediate transfer belt 10 stretched over the driving roller 9 and the driven roller 15. Each of the photoconductors 40 serving as the image carriers is rotatable in a counterclockwise direction. As illustrated in FIG. 2, a charging device 60, a development device 61, a primary transfer device 62, a photoconductor cleaning device 63, and a neutralization device 64 are disposed around each of the photoconductors 40, and an exposure device 21 is provided above the photoconductors 40.

A secondary transfer device 22 serving as a transfer unit is provided below the intermediate transfer belt 10. The secondary transfer device 22 has a secondary transfer roller 7 serving as a transfer member to contact with and separate from the driven roller 16 via the intermediate transfer belt 10, and a base member 8 (see FIGS. 3A and 3B) to rotatably support the secondary transfer roller 7. The secondary transfer device 22 collectively transfers toner images formed on the intermediate transfer belt 10 to a sheet serving as a recording sheet to be fed between the secondary transfer device 22 and the intermediate transfer belt 10. A fixing device 25 is provided at a position downstream from the secondary transfer device 22 in a sheet conveyance direction. The fixing device 25 has an endless fixing belt 26 and a pressure roller 27 to come into pressure contact with the fixing belt 26 and fixes the toner image transferred onto the sheet. The sheet having passed through the secondary transfer device 22 is fed to the fixing device 25 by an endless conveyance belt 24 stretched over a pair of tension rollers 23. Moreover, a sheet reverse device 28 is provided below the secondary transfer device 22 to reverse and convey a sheet in formation of images on both a front face and a back face of the sheet.

When an image is formed in the image forming apparatus 100 having the above-described configuration, a document is usually set on a document table 30 of the ADF 4. When the ADF 4 is not used, however, the ADF 4 is opened to set the document on an exposure glass 32 of the scanner 3, and the ADF 4 is closed to press the document onto the exposure glass 32.

When the document is set on the document table 30, a start switch is pressed down to automatically feed the document onto the exposure glass 32. By contrast, when the ADF 4 is not used, the scanner 3 is immediately activated so that a first scanning body 33 and a second scanning body 34 start to run. As a result, light emitted from a light source of the first scanning body 33 is irradiated toward the document and light reflected from a document face is reflected in a direction toward the second scanning body 34 by a mirror of the first scanning body 33. Furthermore, the reflected light changes a direction by 180 degrees through a pair of mirrors of the second scanning body 34 and is thus incident on a reading sensor 36 via an imaging lens 35 so that the contents of the document are read.

When the above-described start switch is pressed down, the intermediate transfer belt 10 starts to run, and at the same time, the respective photoconductors 40 also start to rotate. As a result, respective single-color images of yellow, magenta, cyan and black are formed on the respective photoconductors 40. The respective single-color images thus formed are superposed and transferred onto the running intermediate transfer belt 10. Thus, a composite color toner image of a full color is formed on the intermediate transfer belt 10.

When the sheet feed roller 42 provided corresponding to a sheet feed stage selected in the sheet feed table 2 is rotated, sheets are fed from a sheet feed cassette 44 selected in a paper bank 43 and are separated sheet by sheet by a separation roller 45, and fed to a sheet feed passage 46. The sheet thus fed is supplied to a sheet feed passage 48 of the apparatus body 1 by a conveyance roller 47, and contacts a nipping portion of paired registration rollers 49 and is stopped temporarily. For manual sheet feed, a sheet set on a bypass tray 51 is fed by rotation of a bypass sheet feed roller 50, and contacts the nipping portion of the paired registration rollers 49 and is temporarily stopped.

In both cases, the paired registration rollers 49 start to rotate in response to a color image on the intermediate transfer belt 10 and feed the temporarily stopped sheet into a part between the intermediate transfer belt 10 and the secondary transfer device 22, and the secondary transfer device 22 transfer the color image onto the sheet. The sheet having the color image transferred thereon is conveyed to the fixing device 25 by the conveyance belt 24 and is heated and pressurized to fix the transfer image on the sheet. The sheet is guided to an output side by a switching hook 55 and is discharged and stacked onto an output tray 57 by an output roller 56. In a case in which a duplex image formation mode is selected, the sheet having the image formed on the front face is guided toward the sheet reverse device 28 by the switching hook 55 and is reversed and guided to a transfer position again to form an image on the back face. The sheet is discharged onto the output tray 57 by the output roller 56.

In a case in which a monochromatic image of black is formed on the intermediate transfer belt 10, the driven rollers 15 and 16 other than the driving roller 9 are moved to separate the photoconductors 40Y, 40M, and 40C respectively for yellow, magenta and cyan from the intermediate transfer belt 10. For a so-called single-drum type image forming apparatus including one photoconductor differing from the tandem type illustrated in FIG. 1, first, a black image is typically formed to increase a first print speed. In a case in which a document is colored, images of the residual colors are subsequently formed.

With the above-described configuration, the paired registration rollers 49 are typically grounded for use. In some embodiments, a bias is applied to remove paper dust of the sheet. For example, in a case in which a bias is applied by a conductive rubber roller having a diameter of 18 mm and including a front face coated with a conductive nitrile rubber (NBR) at a thickness of 1 mm, the volume resistivity of a rubber material is approximately 109 Ωcm. A voltage of approximately −800V is applied to the front face side of the sheet on which toner is to be transferred, and a voltage of approximately +200V is applied to the back face side of the sheet. For the intermediate transfer method, typically, paper dust is unlikely to move to the photoconductors. Therefore, it is less necessary to take the transfer of paper dust into consideration, and there is no problem even if grounding is formed. Typically, a direct current (DC) bias is applied as an applied voltage. In some embodiments, an alternating bias (AC) voltage having a DC offset component is applied to more uniformly charge the sheet. Thus, the front face of the sheet after passing through the paired registration rollers 49 having the bias applied thereto is charged slightly negatively. As a result, for the transfer from the intermediate transfer belt 10 to the sheet, a transfer condition may differ from a case in which a voltage is not applied to the paired registration rollers 49. Hence, in some embodiments, the transfer condition is altered for the transfer from the intermediate transfer belt 10 to the sheet.

Next, an image forming apparatus 100 according to a first exemplary embodiment of this disclosure is described below.

For the first exemplary embodiment, a foamed roller formed by coating a metal core roller with a foamed rubber is used as the secondary transfer roller 7. In this exemplary embodiment, NBR rubber is used as a material of the foamed rubber, and the amount of NBR rubber is adjusted so that the foamed rubber has an Asker C hardness of 40 degrees. It is to be noted that the material of the foamed rubber is not particularly limited to NBR rubber and any other suitable material may be used.

Figure 3A:
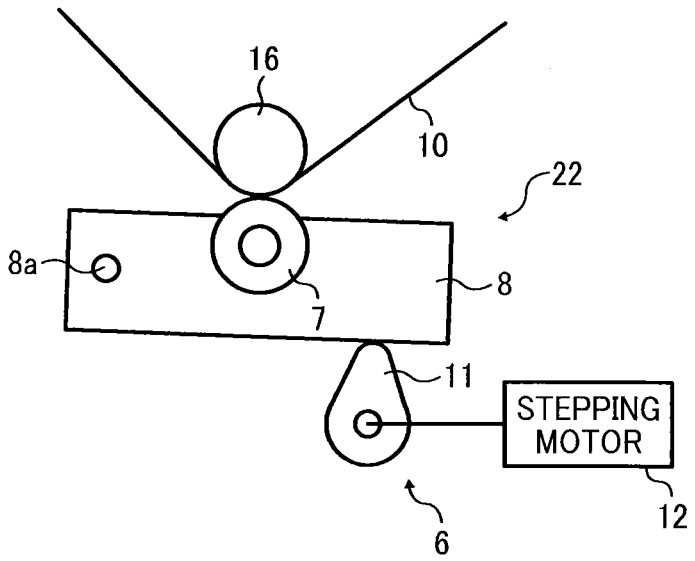
FIGS. 3A and 3B are views of a transfer unit and a contact and separation unit according to at least one exemplary embodiment of the present disclosure.
Figure 3B:
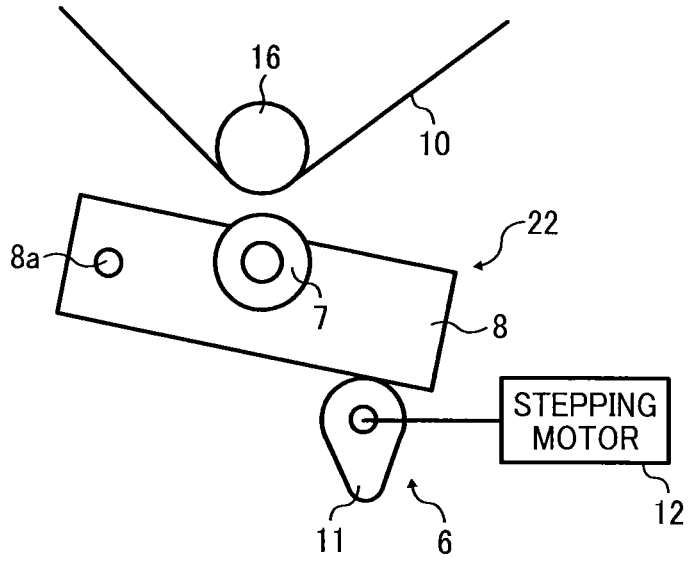

In addition to the above-described configuration, the image forming apparatus 100 has a secondary transfer contact-and-separation assembly 6 serving as a contact-and-separation unit to cause the secondary transfer device 22 to come into contact with and separate from the intermediate transfer belt 10. FIGS. 3A and 3B are schematic views of a configuration of the secondary transfer contact-and-separation assembly 6. FIG. 3A shows a state in which the secondary transfer device 22 and the intermediate transfer belt 10 contact with each other. FIG. 3B shows a state in which the secondary transfer device 22 and the intermediate transfer belt 10 separate from each other. The base member 8 is swingably supported on the apparatus body 1 by a support shaft 8*a*, and the secondary transfer contact-and-separation assembly 6 is provided below the base member 8. The secondary transfer contact-and-separation assembly 6 has a rotatable cam 11 disposed in contact with the base member 8 and a stepping motor 12 for rotating and driving the cam 11. The secondary transfer contact-and-separation assembly 6 rotates the cam 11 by a predetermined angle by stepping motor 12 so that the secondary transfer device 22 is selectively positioned into the state illustrated in FIG. 3A and the state illustrated in FIG. 3B.

Furthermore, in addition to the above-described configuration, a toner pattern is formed on the intermediate transfer belt 10 corresponding to an inter-sheet area, and the secondary transfer device 22 is separated from the intermediate transfer belt 10 by the secondary transfer contact-and-separation assembly 6 in the inter-sheet area. In addition, before a next sheet reaches the secondary transfer device 22, the secondary transfer device 22 is brought into contact with the intermediate transfer belt 10. An image of the toner pattern is formed in the inter-sheet area by the same principle as that of an ordinary toner image. More specifically, a toner image is formed by the photoconductor 40, the charging device 60, and the development device 61 illustrated in FIG. 2.

Next, a description is given of toner density control using the toner pattern.

Figure 4:
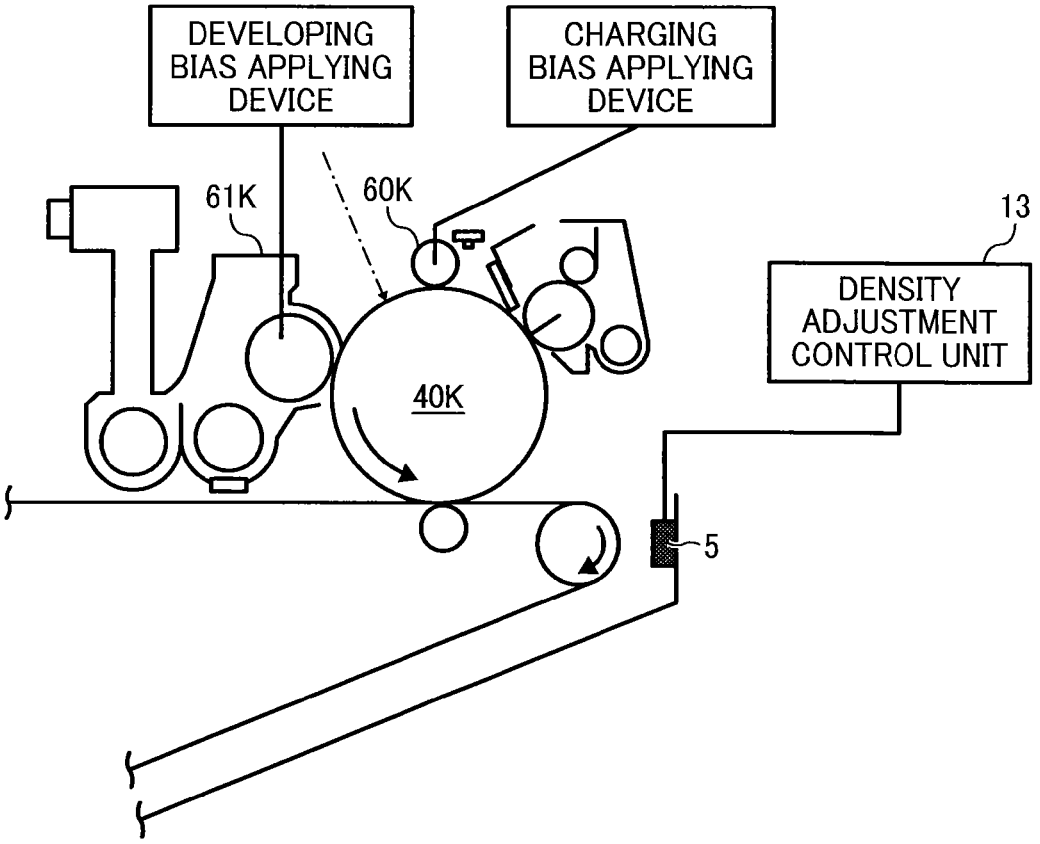
FIG. 4 is a schematic view of a toner density adjustment assembly of an image forming apparatus according to at least one exemplary embodiment of the present disclosure.

An adhesion amount of the toner pattern is detected by a toner adhesion amount sensor 5 illustrated in FIG. 4, and an adjustment control unit 13 controls at least one of a toner replenishment motor, a developing bias and a charging bias, based on a detected value of the adhesion amount, to adjust an image density. In a case in which the adjustment is carried out by the control of the toner replenishment motor, the toner density is adjusted by regulating the toner replenishment to adjust the image density. In a case in which the adjustment is carried out by the control of the development bias and the charging bias, the image density is adjusted by regulating a bias value. Although a black image forming unit is illustrated in FIG. 4, the adjustment is carried out over all colors in actual control.

Figure 5:
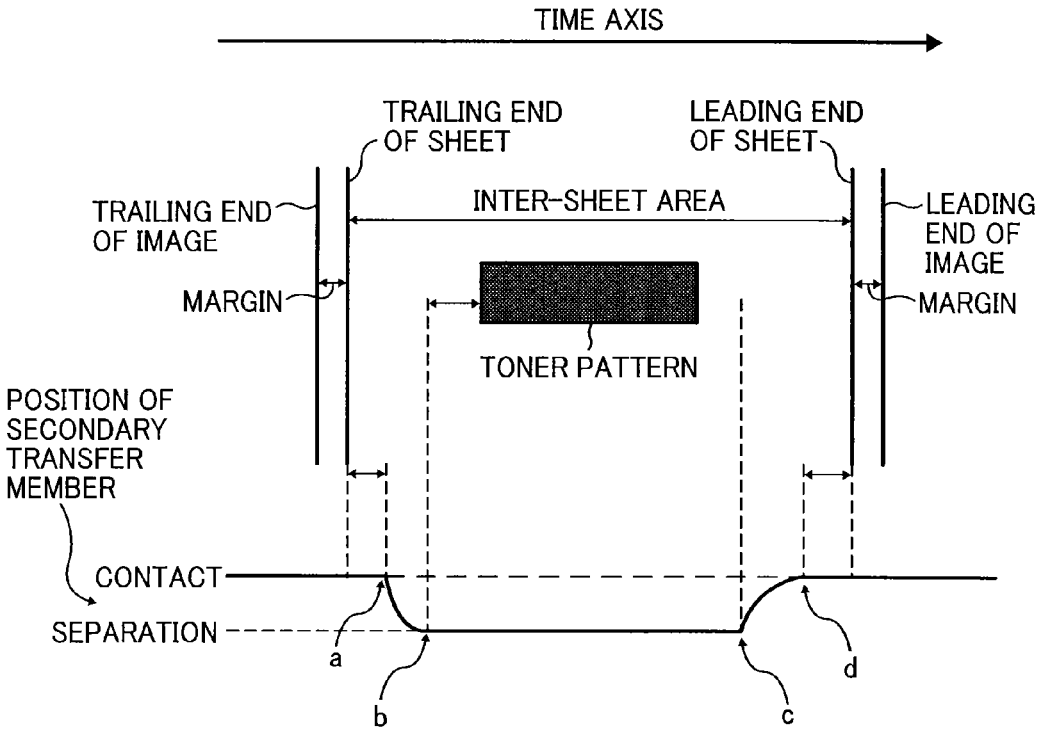
FIG. 5 is a schematic diagram of a state of a secondary transfer device in an inter-sheet area in a first exemplary embodiment of the present disclosure.

FIG. 5 shows a state of the secondary transfer device 22 in the inter-sheet area according to the first exemplary embodiment of the present disclosure. The secondary transfer device 22 performs the contact-and-separation operation through the secondary transfer contact-and-separation assembly 6 in the inter-sheet area in order from a to d which is described below. a. After a trailing end of the sheet passes through a contact part of the secondary transfer device 22 and the intermediate transfer belt 10, the secondary transfer contact-and-separation assembly 6 starts to separate the secondary transfer roller 7 from the intermediate transfer belt 10. b. The separation is completed before the toner pattern reaches the contact part. c. After the toner pattern passes through the contact part, the secondary transfer contact-and-separation assembly 6 starts to bring the secondary transfer roller 7 into contact with the intermediate transfer belt 10. d. Before a leading end of a subsequent sheet reaches the contact part, the contact action of the secondary transfer roller 7 with the intermediate transfer belt 10 is completed.

Figure 6:
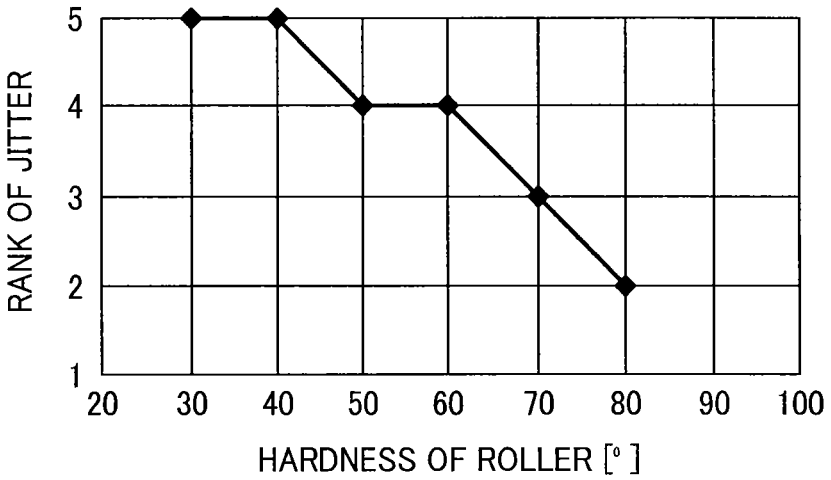
FIG. 6 is a chart of an evaluation result of a shock jitter in the first exemplary embodiment of the present disclosure.

With the above-described configuration, FIG. 6 shows an evaluation result of a shock jitter (a horizontal-band-like image failure caused by vibration of a writing unit due to prevention of running of the intermediate transfer belt 10 or transmission of a vibration when a sheet enters the transfer unit). The evaluation is carried out in a visual observation rank of five stages. The rank 5 indicates the most excellent evaluation having no jitter, the rank 1 indicates the worst evaluation, and a permissible rank is equal to or greater than the rank 4. A sheet used in an evaluation test is a cardboard having a basis weight of 300 g/m$^2$. To evaluate influence on primary transfer, development and writing in feed of the sheet, the worst jitter caused by passage of ten evaluation sheets is evaluated. In addition to the foamed roller having the Asker C hardness of 40 degrees to be used in the first exemplary embodiment, foamed rollers having an Asker C hardness of 70 degrees, 60 degrees, 50 degrees or 30 degrees and a solid rubber roller having an Asker C hardness of 80 degrees are also used for comparison, as the secondary transfer roller 7.

As illustrated in FIG. 6, it is found that the jitter is unlikely to occur when the secondary transfer roller 7 has a lower hardness, the jitter is within a permissible range when the Asker C hardness is equal to or greater than 60 degrees, and the jitter is improved so as not to be visually seen when the Asker C hardness is equal to or smaller than 40 degrees. However, as the roller hardness is reduced, the roller is likely to be deformed by repetitive pressure. For this reason, it is preferable that the roller hardness is not unnecessarily reduced.

As described above, by using a soft foamed roller as a material of the secondary transfer roller 7, it is possible to suppress a vibration caused by the entrance of the cardboard into the secondary transfer device 22 and collision with the secondary transfer roller 7. Such a configuration prevents the vibration from being transmitted to the primary transfer device 62, the development device 61 and the exposure device 21, thus preventing occurrence of shock jigger. Moreover, if toner adheres to such foamed roller, the toner may not be easily removed from the foamed roller. Hence, in this exemplary embodiment, the operation of the secondary transfer contact-and-separation assembly 6 is controlled in such a manner that the secondary transfer roller 7 does not come into contact with the intermediate transfer belt 10 in the inter-sheet area. Such a configuration prevents occurrence of a failure, such as contamination of toner to the back face of the sheet, which is caused by the transfer of toner from the front face of the intermediate transfer belt 10 to the secondary transfer roller 7.

Furthermore, it may be difficult to constantly clean the formed roller with a cleaning member such as a cleaning blade. As a result, when the borderless image formation is carried out, toner transferred outside the sheet might contaminate the front face of the secondary transfer roller 7, thus causing contamination on the back face or a cut end of the sheet after one rotation of secondary transfer roller 7. Hence, by limiting the borderless image formation to a trailing end of the sheet, toner transferred outside the sheet in the image formation can be cleaned in the inter-sheet area, however, thus preventing occurrence of contamination on the back face or the cut end of the sheet.

Next, a description is given to bordered image formation, borderless image formation and trailing-end-borderless image formation.

Figure 7A:
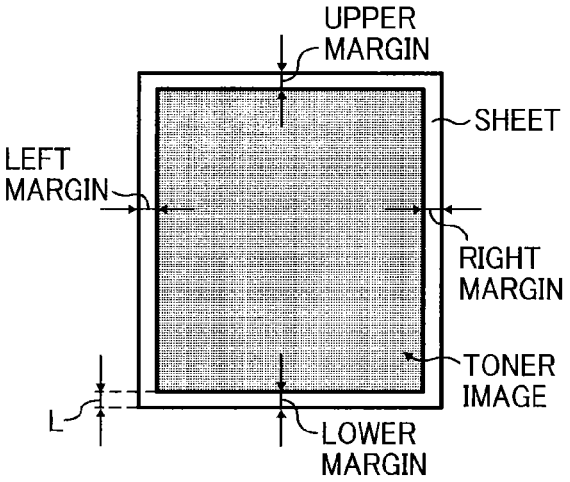
FIGS. 7A to 7C are schematic views of trailing-end-borderless image formation to be used in at least one exemplary embodiment of the present disclosure.
Figure 7B:
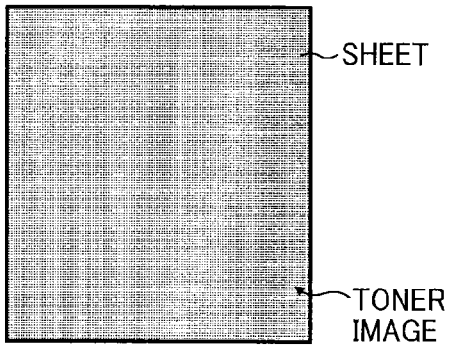
Figure 7C:
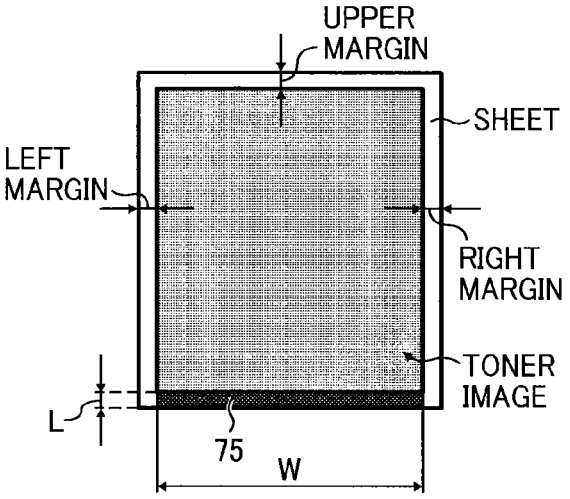

FIG. 7A shows an example of bordered image formation, FIG. 7B shows an example of borderless image formation, and FIG. 7C shows an example of trailing-end-borderless image formation. In the bordered image formation, a toner image is wholly included in a sheet and margins (an upper margin, a lower margin, a left margin and a right margin) are present in upper, lower, left and right parts of the sheet. In the borderless image formation, a toner image is present even on an edge of the sheet and there is no margin.

Figure 8:
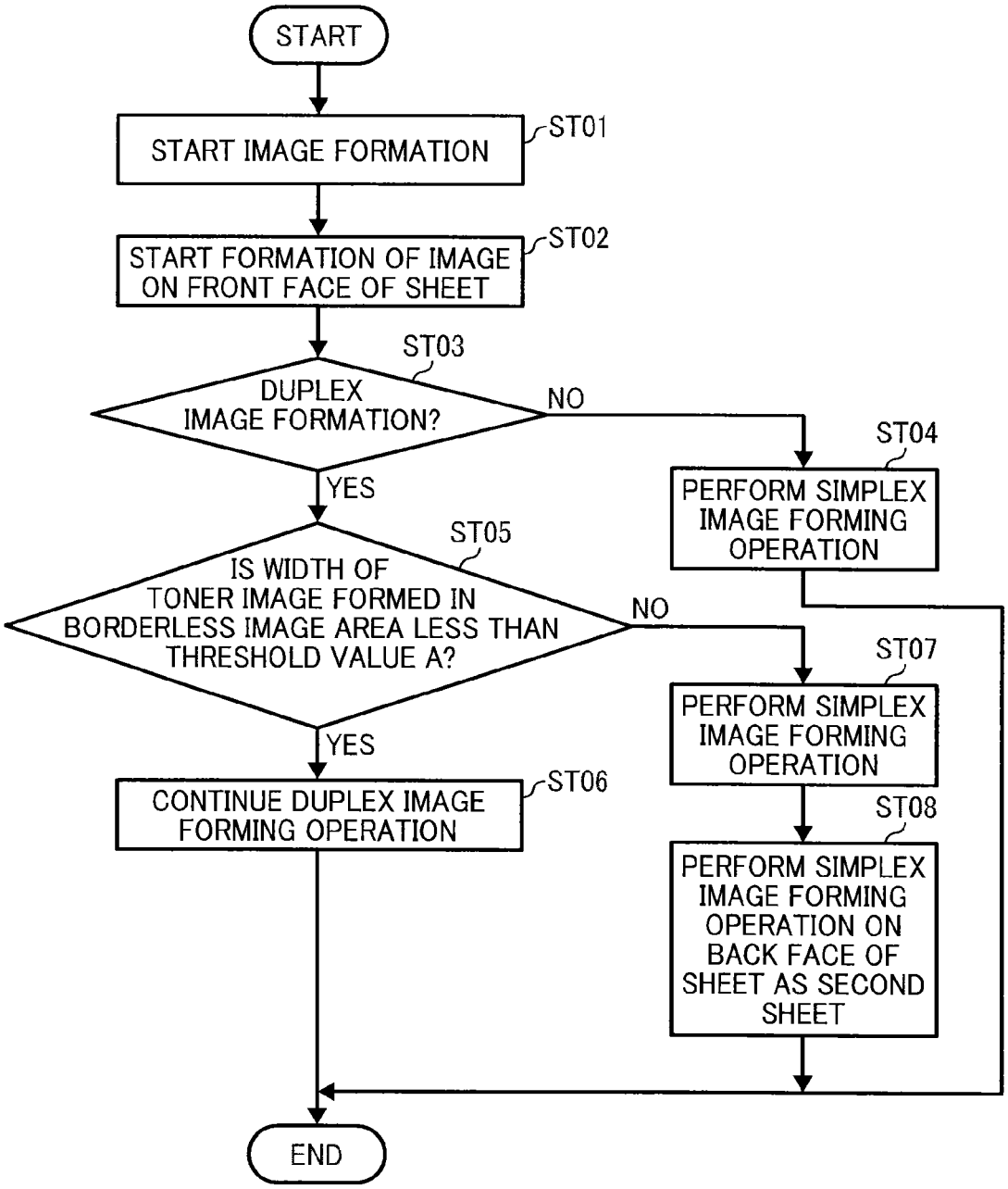
FIG. 8 is a flow chart of an image forming operation in the first exemplary embodiment of the present disclosure.

In the trailing-end-borderless image formation, a toner image is present even on a lower end of the sheet, and there is no lower margin but the upper, left and right margins are present. In FIG. 7C, a borderless image area 75 indicates an area having a length L from an edge of the trailing end of the sheet. The borderless image area 75 is a trailing end area originally to be a margin, in which a toner image can be formed in the trailing-end-borderless image formation. In the first exemplary embodiment of the present disclosure, control for selecting whether duplex image formation is permitted is carried out depending on a width W in which a toner image is to be formed in the borderless image area 75, that is, a width W of the toner image formed in the area in a direction perpendicular to a sheet conveyance direction. The control is carried out by a control unit 99 such as a CPU. FIG. 8 is a flow chart of the control.

In FIG. 8, when the start switch of the image forming apparatus 100 is pressed down, an image forming operation is started (ST01), formation of a front face image is started (ST02), and it is determined whether the duplex image formation is to be carried out or not (ST03). When it is determined that the duplex image formation is not to be carried out at step ST03, a simplex image forming operation is performed (ST04) and the processing is then ended.

Figure 16A:
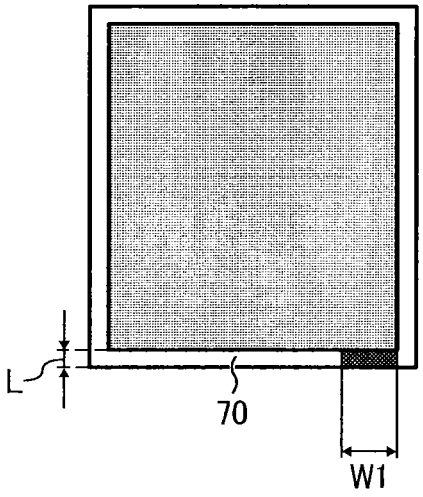
FIGS. 16A and 16B are schematic views illustrating examples of a toner image formed in a borderless image area in the first exemplary embodiment of the present disclosure.
Figure 16B:
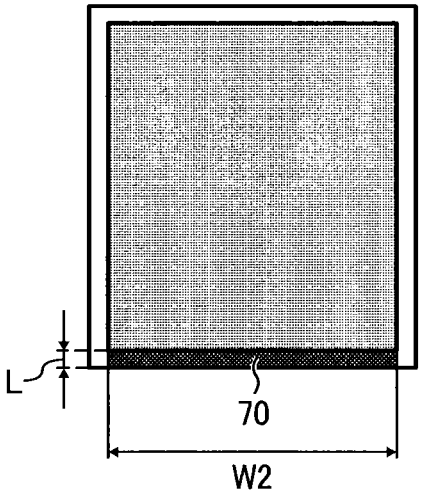

When it is determined that the duplex image formation is to be carried out at step ST03, it is determined whether the width W of the toner image to be formed in the borderless image area 75 is smaller than a predetermined value A or not (ST05). When the width W is smaller than the predetermined value A, the duplex image forming operation is carried out continuously (ST06). When it is determined that the width W is equal to or greater than the predetermined value A at step ST05, the simplex image forming operation is carried out (ST07), the simplex image forming operation is continuously performed with a back face image set to be a second sheet (ST08), and the processing is then ended. The width W has a maximum value of continuous pixels in the direction perpendicular to the sheet conveyance direction, and a controller provided in a body makes a decision in image reading or image input. FIGS. 16A and 16B illustrate examples of a toner image to be formed in the borderless image area 75. In FIG. 16A, a width of the toner image is indicated as W1. In FIG. 16B, the width of the toner image is indicated as W2.

When a toner image is present on a leading end of a sheet, adhesion force is generated between the fixing member and the toner in the case in which a toner is molten in the fixing member. Thus, the sheet is likely to be caught in the fixing member, thus causing a jam. As a toner image area on the leading end of the sheet is larger, the adhesion force of the sheet and the fixing member is increased. Consequently, the winding is likely to be caused. By contrast, when the toner image area is equal to or smaller than some extent, the sheet can be separated from the fixing member without being caught even when there is no margin on the leading end.

In the first exemplary embodiment, the duplex image formation is permitted when the width W of the toner image to be formed on the borderless image area 75 having no margin on the trailing end is smaller than the predetermined value A. By contrast, when the width W is equal to or greater than the predetermined value A, the duplex image formation is not permitted. Such a configuration prevents the end of the sheet from being caught in the fixing member, thus preventing a jam in the duplex image formation and allowing continuous execution of excellent duplex image formation. The predetermined value A in the first exemplary embodiment may vary depending on an area of a toner image, a type or thickness of a sheet, a type of a toner, an environmental condition or the like. For example, when the toner image area is assumed to be 100% of a solid image, the width W is preferably approximately 20% of the width of the sheet in the direction perpendicular to the sheet conveyance direction.

Next, a second exemplary embodiment of the present disclosure is described with reference to FIGS. 9A and 9B.

In the second exemplary embodiment, control is carried out to increase a predetermined value to permit a width W of a toner image to be formed on a borderless image area 75 depending on a pixel area of the borderless image area 75.

Figure 9A:
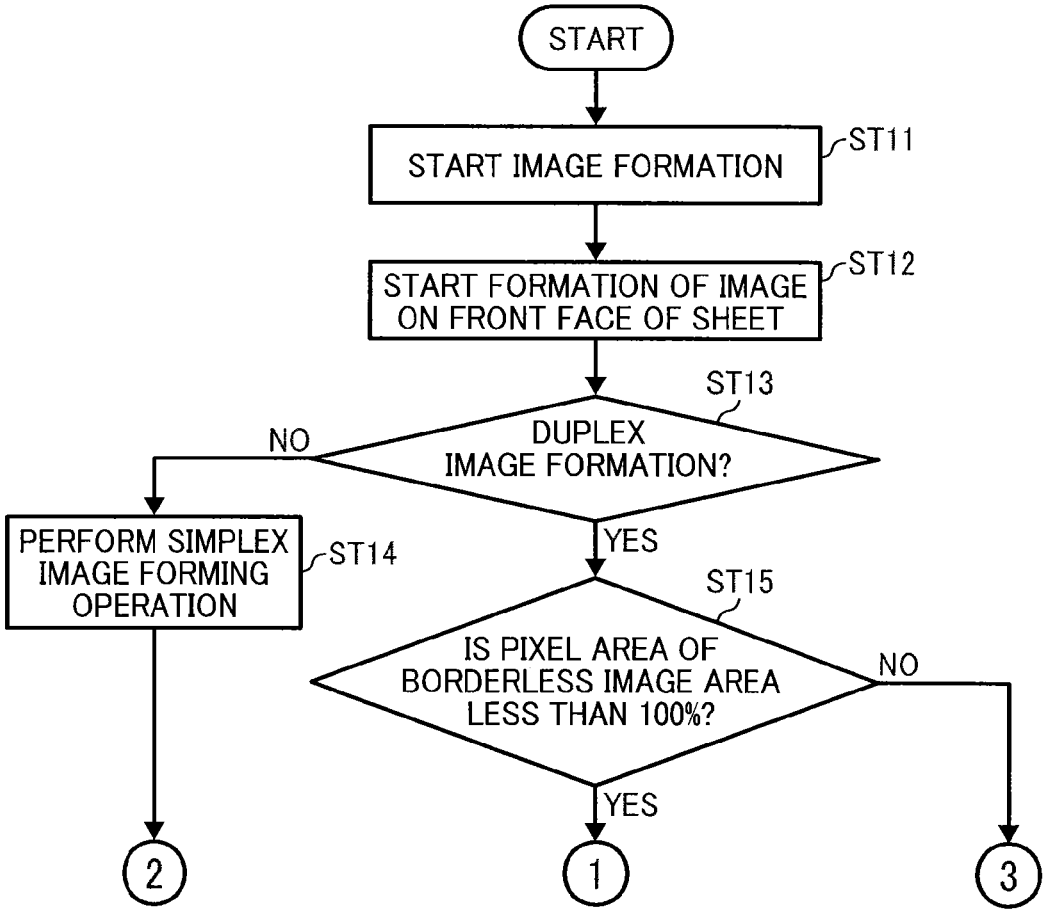
FIGS. 9A and 9B are a flow chart of an image forming operation in a second exemplary embodiment of the present disclosure.
Figure 9B:
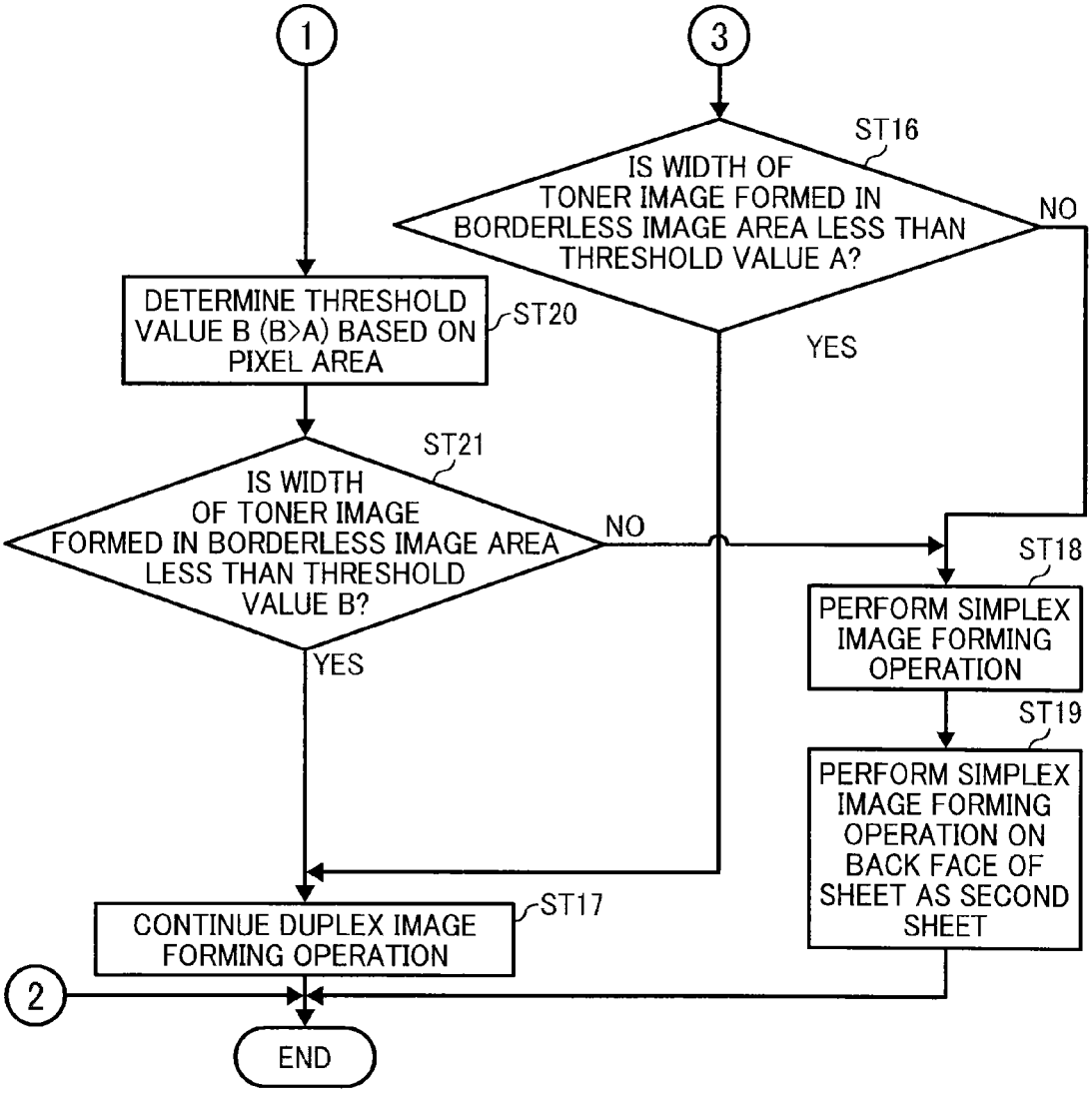

In FIG. 9A, when a start switch of an image forming apparatus 100 is pressed down, an image forming operation is started (ST11), formation of a front face image is started (ST12), and it is determined whether duplex image formation is to be carried out or not (ST13). When it is determined that the duplex image formation is not to be carried out at step ST13, a simplex image forming operation is performed (ST14) and the processing is then ended.

When it is determined that the duplex image formation is carried out at step ST13, it is determined whether a pixel area of the borderless image area 75 is smaller than 100% or not (ST15). When it is determined that the pixel area is 100%, it is determined whether the width W of the toner image to be formed on the borderless image area 75 is smaller than a predetermined value A or not in the same manner as in the first exemplary embodiment (ST16). When the width W is smaller than the predetermined value A, a duplex image forming operation is carried out continuously (ST17). When it is determined that the width W is equal to or greater than the predetermined value A at step ST16, a simplex image forming operation is carried out (ST18), the simplex image forming operation is continuously performed with a back face image set to be a second sheet (ST19), and the processing is then ended. The pixel area of the borderless image area 75 is set to be a sum of pixels present in the borderless image area 75 illustrated in FIG. 7C, and a controller provided in a body makes the decision in image reading or image input.

When it is determined that the pixel area of the borderless image area 75 is smaller than 100% at step ST15, a predetermined value B for defining an upper limit of the width W of the toner image to be formed on the borderless image area 75 is determined based on the determined pixel area (ST20). The width W is defined in such a manner that the predetermined value A is approximately 20% of the width of a sheet in a direction perpendicular to a sheet conveyance direction when a toner image area to be a pixel area is 100%. From the foregoing, the predetermined value B defines the width W so as to be approximately 25% of the width of the sheet in the direction perpendicular to the sheet conveyance direction when the pixel area is 80%, and to be approximately 28.6% of the width of the sheet in the direction perpendicular to the sheet conveyance direction when the pixel area is 70%, for example.

Next, it is determined whether or not the width W of the toner image to be formed on the borderless image area 75 is smaller than the predetermined value B determined at step ST20 (ST21). When the width W is smaller than the predetermined value B, the duplex image forming operation is continuously carried out (ST17). When it is determined that the width W is equal to or greater than the predetermined value B at step ST21, the simplex image forming operation is carried out (ST18). The simplex image forming operation is performed continuously with a back face image set to be a second sheet (ST19), and the processing is then ended.

As a toner adhesion amount on a leading end of a sheet is larger, adhesion force of a toner and a fixing member is increased. As a result, adhesion force of the sheet and the fixing member is also increased. For this reason, the sheet is likely to be caught in the fixing member. Even when the toner image area is small, the adhesion force is increased and the sheet is likely to be caught when a toner adhesion amount per unit area is increased. By contrast, even when the toner image area is larger, the sheet is unlikely to be caught when the toner adhesion amount per unit area is smaller.

In the second exemplary embodiment, when the pixel area of the borderless image area 75 having no margin on a trailing end is smaller than 100%, the predetermined value B of the width W is set to be greater than the predetermined value A in accordance with the pixel area. When the width W is equal to or greater than the predetermined value B, the duplex image formation is prohibited. Such a configuration prevents a jam from being caused by the end of the sheet caught in the fixing member in the duplex image formation in more toner images than those in the first exemplary embodiment. Thus, excellent duplex image formation can be continuously performed.

Next, a third exemplary embodiment of the present disclosure is described with reference to FIGS. 10A and 10B.

In the third exemplary embodiment, control is carried out to increase a predetermined value to permit a width W of a toner image to be formed on a borderless image area 75 depending on a thickness of a recording sheet.

Figure 10A:
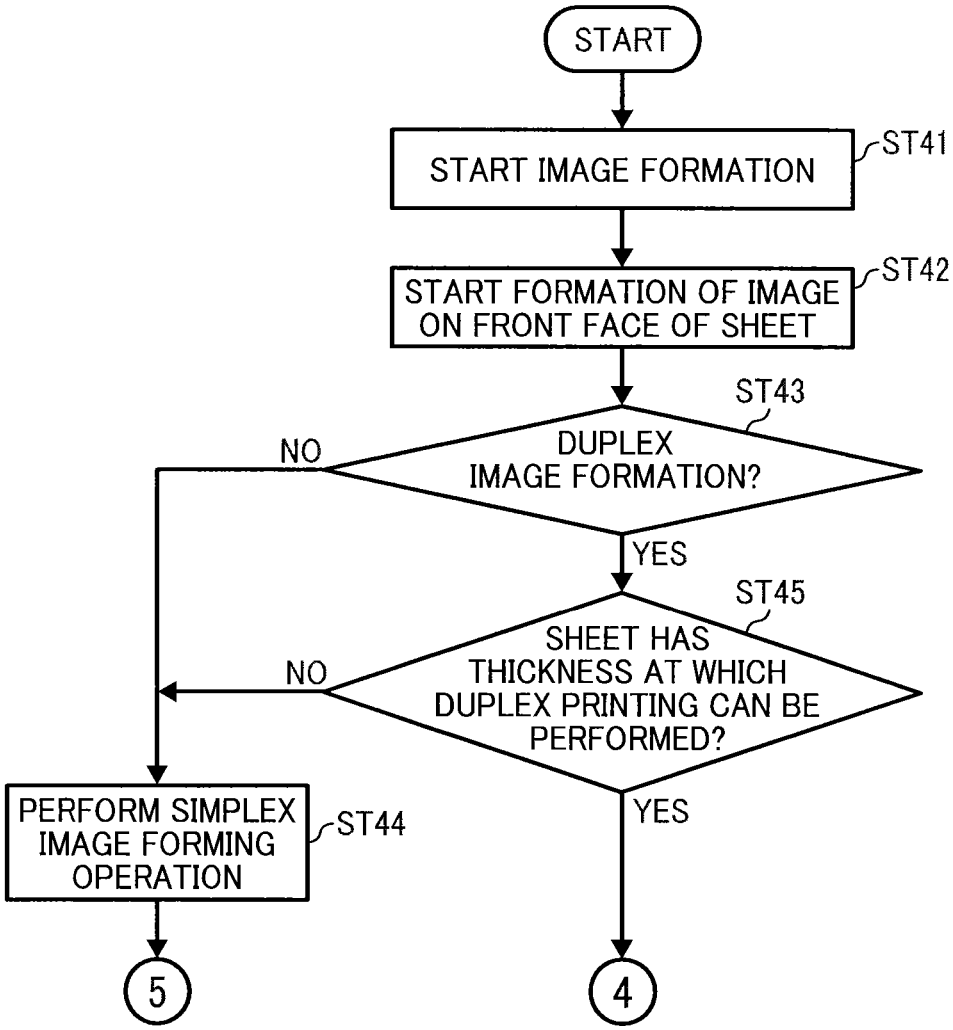
FIGS. 10A and 10B are a flow chart of an image forming operation in a third exemplary embodiment of the present disclosure.
Figure 10B:
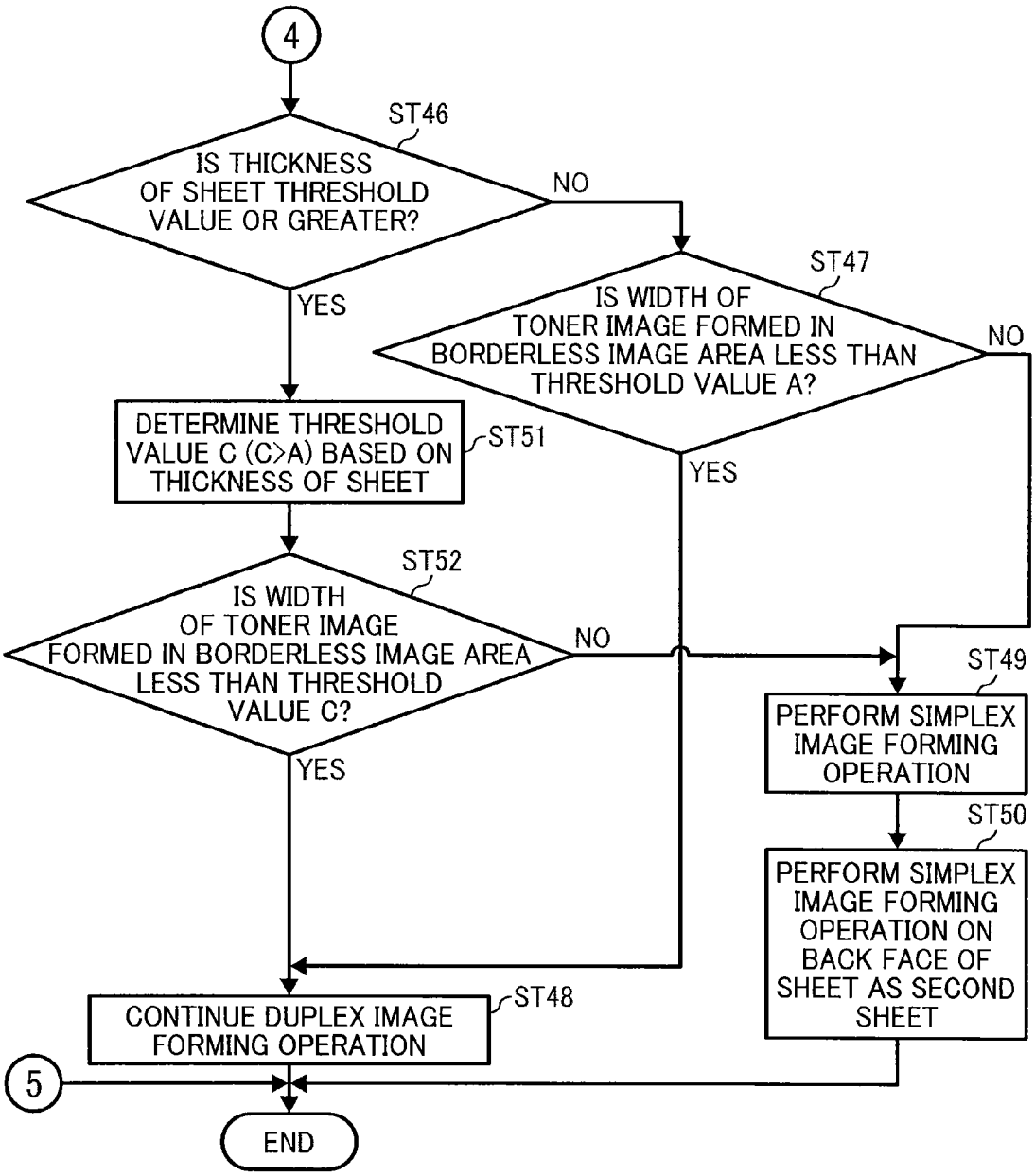

In FIG. 10A, when a start switch of an image forming apparatus 100 is pressed down, an image forming operation is started (ST41), formation of a front face image is started (ST42), and it is determined whether duplex image formation is to be carried out or not (ST43). When it is determined that the duplex image formation is not to be carried out, a simplex image forming operation is performed (ST44) and the processing is then ended.

When it is determined that the duplex image formation is to be carried out at step ST43, it is determined whether or not the thickness of the recording sheet is a thickness with which a duplex image can be formed (ST45). When it is determined that the thickness of the recording sheet is not the thickness with which the duplex image can be formed, the processing proceeds to step ST44 and the simplex image forming operation is performed, and the processing is then ended. If the thickness of the recording sheet is equal to or greater than a reference value, the recording sheet may not smoothly enter a conveyance passage for duplex image formation due to the rigidity of the recording sheet, resulting in a recording sheet conveyance jam. For this reason, the duplex image formation is generally not permitted for the recording sheet having the thickness which is equal to or greater than the reference value.

When it is determined that the thickness of the recording sheet is the thickness with which the duplex image can be formed at step ST45, it is determined whether or not the thickness of the recording sheet is equal to or greater than a predetermined thickness (ST46). When it is determined that the thickness of the recording sheet is smaller than the predetermined thickness, it is determined whether a width W of a toner image to be formed on the borderless image area 75 is smaller than a predetermined value A or not in the same manner as in the first exemplary embodiment (ST47). When the width W is smaller than the predetermined value A, a duplex image forming operation is continuously carried out (ST48). When it is determined that the width W is equal to or greater than the predetermined value A at step ST47, the simplex image forming operation is carried out (ST49), the simplex image forming operation is continuously performed with a back face image set to be a second sheet (ST50), and the processing is then ended. The pixel area of the borderless image area 75 is set to be a sum of pixels present in the borderless image area 75 illustrated in FIG. 7C, and a controller provided in a body makes the decision in image reading or image input.

When it is determined that the thickness of the recording sheet is equal to or greater than the predetermined thickness at step ST46, a predetermined value C for defining an upper limit of the width W of the toner image to be formed on the borderless image area 75 is determined based on the thickness of the recording sheet (ST51). The predetermined value A defines the width W to be approximately 20% of the width of the sheet in a direction perpendicular to a recording sheet conveyance direction when the thickness of the recording sheet is smaller than 120 g/m$^2$, for example. On the other hand, the predetermined value C defines the width W to be approximately 45% of the width of the sheet in the direction perpendicular to the recording sheet conveyance direction in the case of 180 g/m$^2$, and to be approximately 60% of the width of the sheet in the direction perpendicular to the recording sheet conveyance direction in the case of 240 g/m$^2$, for example.

Next, it is determined whether the width W of the toner image to be formed on the borderless image area 75 is smaller than the predetermined value C determined at step ST51 or not (ST52). When the width W is smaller than the predetermined value C, the processing proceeds to step ST48 and the duplex image forming operation is continuously carried out. When it is determined that the width W is equal to or greater than the predetermined value C at step ST52, the processing proceeds to step ST49 and the simplex image forming operation is carried out. Furthermore, the processing proceeds to step ST50 and the simplex image forming operation is continuously carried out with a back face image set to be a second sheet, and the processing is then ended.

As described above, adhesion force of a toner and a fixing member is increased when a toner adhesion amount on a leading end of a recording sheet is larger. As a result, adhesion force of the recording sheet and the fixing member is also increased. For this reason, the recording sheet is likely to be caught in the fixing member. When the thickness of the recording sheet is increased, force acts more greatly in a peeling direction from the fixing member by the rigidity of the recording sheet. Therefore, the sheet is unlikely to be caught even when the toner adhesion amount is equal. Consequently, the predetermined value C for permitting the duplex image formation may be made greater with increase in the thickness of the recording sheet.

In the third exemplary embodiment, the predetermined value C of a width L is set to be greater than the predetermined value A depending on the thickness of the recording sheet in the case in which the thickness is equal to or greater than a predetermined thickness, and in the case in which the width W is equal to or greater than the predetermined value C, the duplex image forming operation is prohibited. Consequently, it is possible to prevent a jam from being caused in more toner images than those in the first exemplary embodiment, and furthermore, to continuously carry out an excellent duplex image forming operation.

Next, a fourth exemplary embodiment of the present disclosure is described with reference to a flow chart shown in FIGS. 11A to 11C. In the fourth exemplary embodiment, there is carried out control for increasing a predetermined value to permit a width W of a toner image to be formed on a borderless image area 75 depending on both a pixel area of a borderless image area 75 and a thickness of a recording sheet.

Figure 11A:
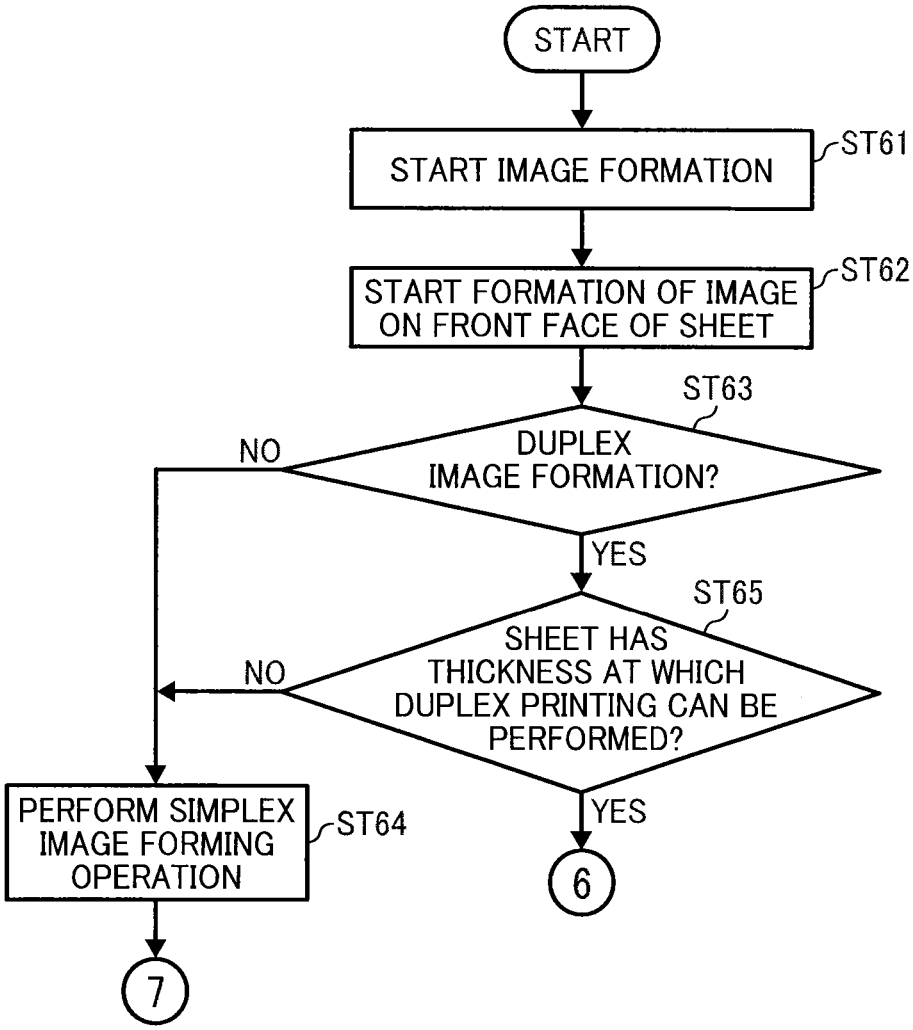
FIGS. 11A to 11C are a flow chart of an image forming operation in a fourth exemplary embodiment of the present disclosure.
Figure 11B:
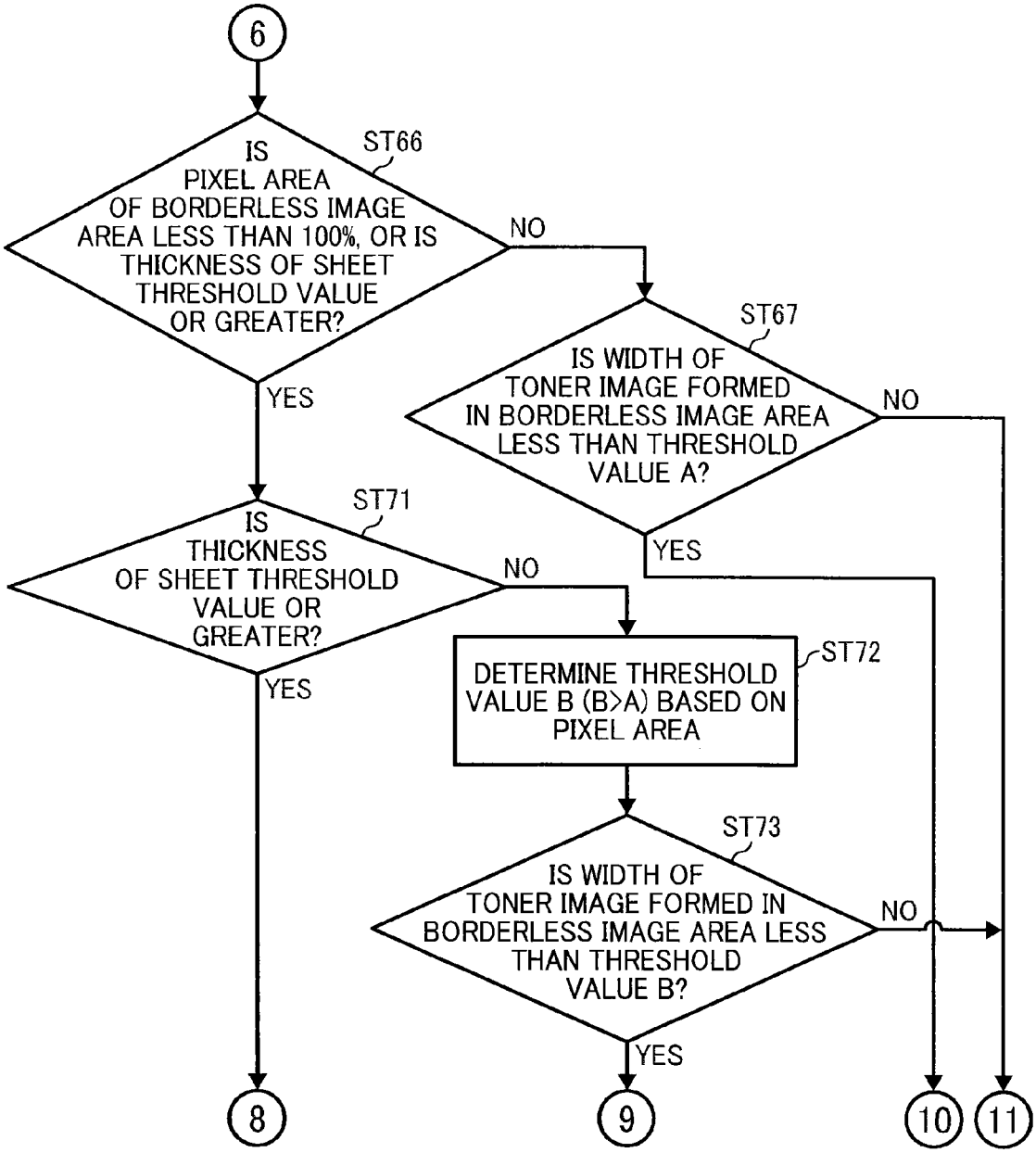
Figure 11C:
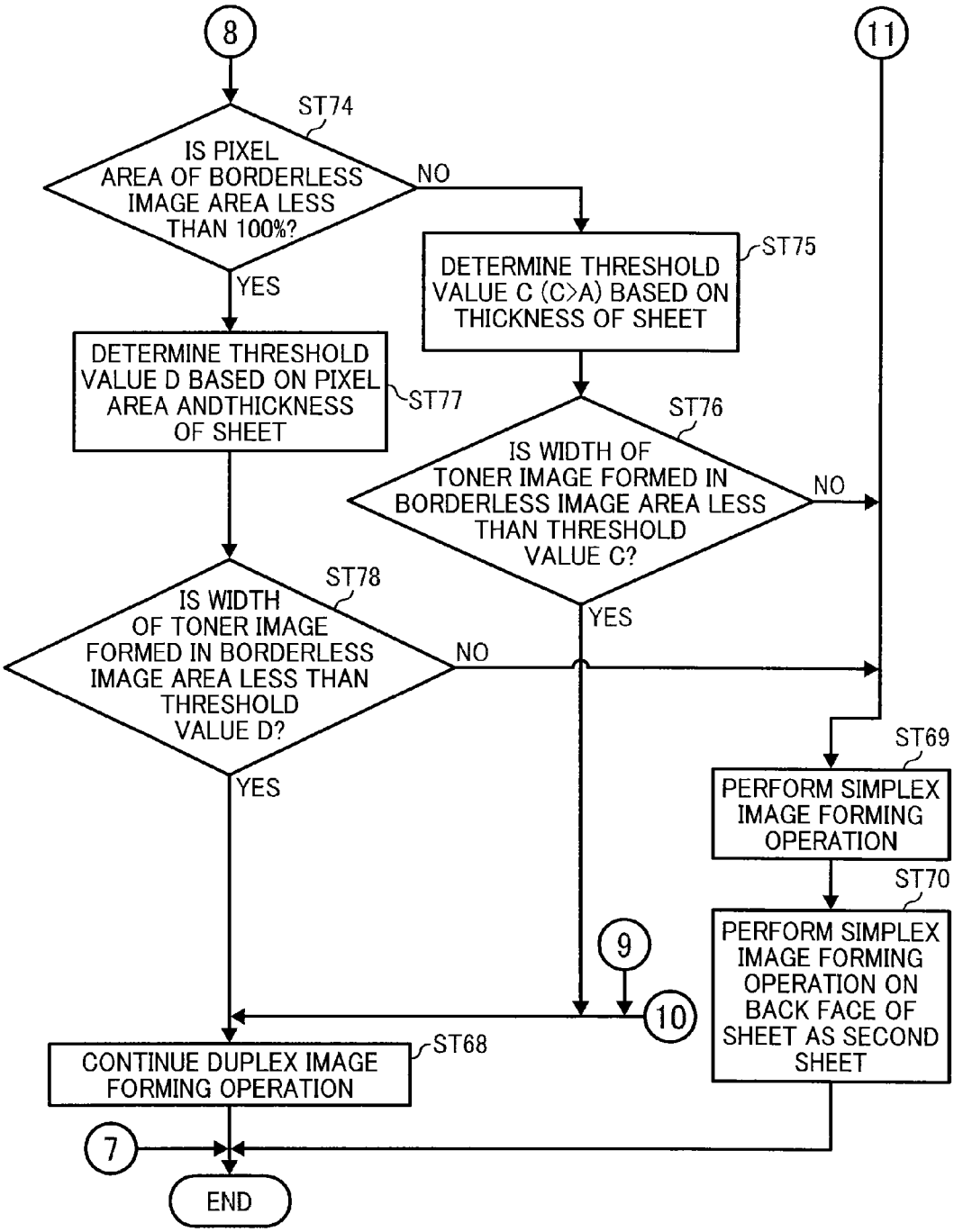

In FIG. 11A, when a start switch of an image forming apparatus 100 is pressed down, an image forming operation is started (ST61), formation of a front face image is started (ST62), and it is determined whether duplex image formation is to be carried out or not (ST63). When it is determined that the duplex image formation is not to be carried out, a simplex image forming operation is performed and the processing is then ended (ST64).

When it is determined that the duplex image formation is carried out at step ST63, it is determined whether or not the thickness of the recording sheet is a thickness with which a duplex image can be formed (ST65). When it is determined that the thickness of the recording sheet is not the thickness with which a duplex image can be formed, the processing proceeds to step ST64 and the processing is then ended. If the thickness of the recording sheet is equal to or greater than a reference value, the recording sheet may not smoothly enter a conveyance passage for duplex image formation due to the rigidity of the recording sheet, resulting in a recording sheet conveyance jam. For this reason, the duplex image formation is generally not permitted for the recording sheet having the thickness which is equal to or greater than the reference value.

When it is determined that the thickness of the recording sheet is the thickness with which a duplex image can be formed at step ST65, it is determined whether or not the pixel area of the borderless image area 75 is smaller than 100% or the thickness of the recording sheet is equal to or greater than a predetermined thickness (ST66). When it is determined that any condition is not satisfied (the pixel area is 100% and the thickness of the recording sheet is smaller than the predetermined thickness), it is determined whether the width W of the toner image to be formed on the borderless image area 75 is smaller than the predetermined value A or not (ST67). When the width W is smaller than the predetermined value A, a duplex image forming operation is continuously carried out (ST68). When the width W is equal to or greater than the predetermined value A, a simplex image forming operation is carried out (ST69), the simplex image forming operation is continuously performed with a back face image set to be a second sheet, and the processing is then ended (ST70). The pixel area of the borderless image area 75 is set to be a sum of pixels present in the borderless image area 75 illustrated in FIG. 7C, and a controller provided in a body makes the decision in image reading or image input.

When it is determined that the pixel area of the borderless image area 75 is smaller than 100% or the thickness of the recording sheet is equal to or greater than the predetermined thickness at step S66, it is subsequently determined whether or not the thickness of the recording sheet is equal to or greater than the predetermined thickness (ST71). When the thickness of the recording sheet is smaller than the predetermined thickness, a predetermined value B for defining an upper limit of the width W of the toner image to be formed on the borderless image area 75 is determined based on the pixel area thus determined (ST72).

Next, it is determined whether the width W of the toner image to be formed on the borderless image area 75 is smaller than the predetermined value B determined at step ST72 or not (ST73). When the width W is smaller than the predetermined value B, the processing proceeds to step ST68 and the duplex image forming operation is continuously carried out. When it is determined that the width W is equal to or greater than the predetermined value B, the processing proceeds to step ST69 and the simplex image forming operation is carried out. Furthermore, the processing proceeds to step ST70 and the simplex image forming operation is continuously carried out with a back face image set to be a second sheet, and the processing is then ended.

When it is determined that the thickness of the recording sheet is equal to or greater than the predetermined thickness at step ST71, it is subsequently determined whether the pixel area of the borderless image area 75 is smaller than 100% or not (ST74). When it is determined that the pixel area is 100%, a predetermined value C for defining the upper limit of the width W of the toner image to be formed on the borderless image area 75 is determined based on the thickness of the recording sheet thus determined (ST75).

Next, it is determined whether the width W of the toner image to be formed on the borderless image area 75 is smaller than the predetermined value C determined at the ST75 or not (ST76). When the width W is smaller than the predetermined value C, the processing proceeds to step ST68 and the duplex image forming operation is continuously carried out. When it is determined that the width W is equal to or greater than the predetermined value C, the processing proceeds to step ST69 and the simplex image forming operation is carried out. Furthermore, the processing proceeds to step ST70 and the simplex image forming operation is continuously carried out with a back face image set to be a second sheet, and the processing is then ended.

When it is determined that the pixel area of the borderless image area 75 is smaller than 100% at step ST74, a predetermined value D for defining the upper limit of the width W of the toner image to be formed on the borderless image area 75 is determined based on the pixel area thus determined and the thickness of the recording sheet (ST77). Next, it is determined whether the width W of the toner image to be formed on the borderless image area 75 is smaller than the predetermined value D or not (ST78). When the width W is smaller than the predetermined value D, the processing proceeds to step ST68 and the duplex image forming operation is continuously carried out. When it is determined that the width W is equal to or greater than the predetermined value D, the processing proceeds to step ST69 and the simplex image forming operation is carried out. Furthermore, the processing proceeds to step ST70 and the simplex image forming operation is continuously carried out with a back face image set to be a second sheet, and the processing is then ended.

In the fourth exemplary embodiment, to decide whether the duplex image formation is permitted or prohibited, there are the predetermined values A, B, C and D for determining the upper limit of the width W of the toner image to be formed on the borderless image area 75. FIG. 12 is a table of an example of the predetermined values A, B, C and D. With reference to FIG. 12, the respective predetermined values A, B, C and D are determined in the following manner.

The predetermined value A: when the pixel area is 100% and the thickness of the recording sheet is smaller than a predetermined value (120 g/m$^2$), the decision is made with the predetermined value A. The value is set to be 20%, for example. The predetermined value B: when the pixel area is smaller than 100% and the thickness of the recording sheet is smaller than the predetermined value (120 g/m$^2$), the decision is made with the predetermined value B. The predetermined value B is determined based on the pixel area, and is set to be B1 (for example, 25%) when the pixel area is equal to or greater than 60% and is smaller than 100%, is set to be B2 (for example, 30%) when the pixel area is equal to or greater than 30% and is smaller than 60%, or is set to be B3 (for example, 35%) when the pixel area is smaller than 30%, for example. The predetermined value C: when the pixel area is 100% and the thickness of the recording sheet is the predetermined value (120 g/m$^2$) or more, the decision is made with the predetermined value C. The predetermined value C is determined based on the thickness of the recording sheet, and is set to be C1 (for example, 40%) when the thickness is equal to or greater than 120 g/m$^2$ and is smaller than 200 g/m$^2$, or is set to be C2 (for example, 60%) when the thickness is equal to or greater than 200 g/m m$^2$ and is smaller than 260 g/m$^2$, for example. It is assumed that the duplex image formation is not permitted when the thickness is equal to or greater than 260 g/m$^2$. The predetermined value D: when the pixel area is smaller than 100% and the thickness of the recording sheet is equal to or greater than the predetermined value (120 g/m$^2$), the decision is made with the predetermined value D. The predetermined value D is determined based on both the pixel area and the thickness of the recording sheet, and D1 to D6 are determined according to a criterion illustrated in FIG. 12, for example. There are set D1=45%, D2=50%, D3=55%, D4=65%, D5=70% and D6=75%. Although there has been described the example in which the predetermined value is determined from the range of the pixel area and the thickness of the recording sheet in accordance with the determined table, the predetermined value may be calculated based on a value of the area and a numeric value of the thickness.

In the fourth exemplary embodiment, in the case in which the pixel area of the borderless image area 75 is smaller than 100% and the thickness of the recording sheet is equal to or greater than a predetermined thickness, the predetermined value D of the upper limit value of the width W is set to be greater than the predetermined value A depending on both the pixel area and the thickness of the recording sheet. When the width W is equal to or greater than the predetermined value D, the duplex image formation is prohibited. In more toner images than those in the first to third exemplary embodiments, consequently, it is possible to prevent a jam from being caused, and furthermore, to continuously carry out excellent duplex image formation.

Figure 13:
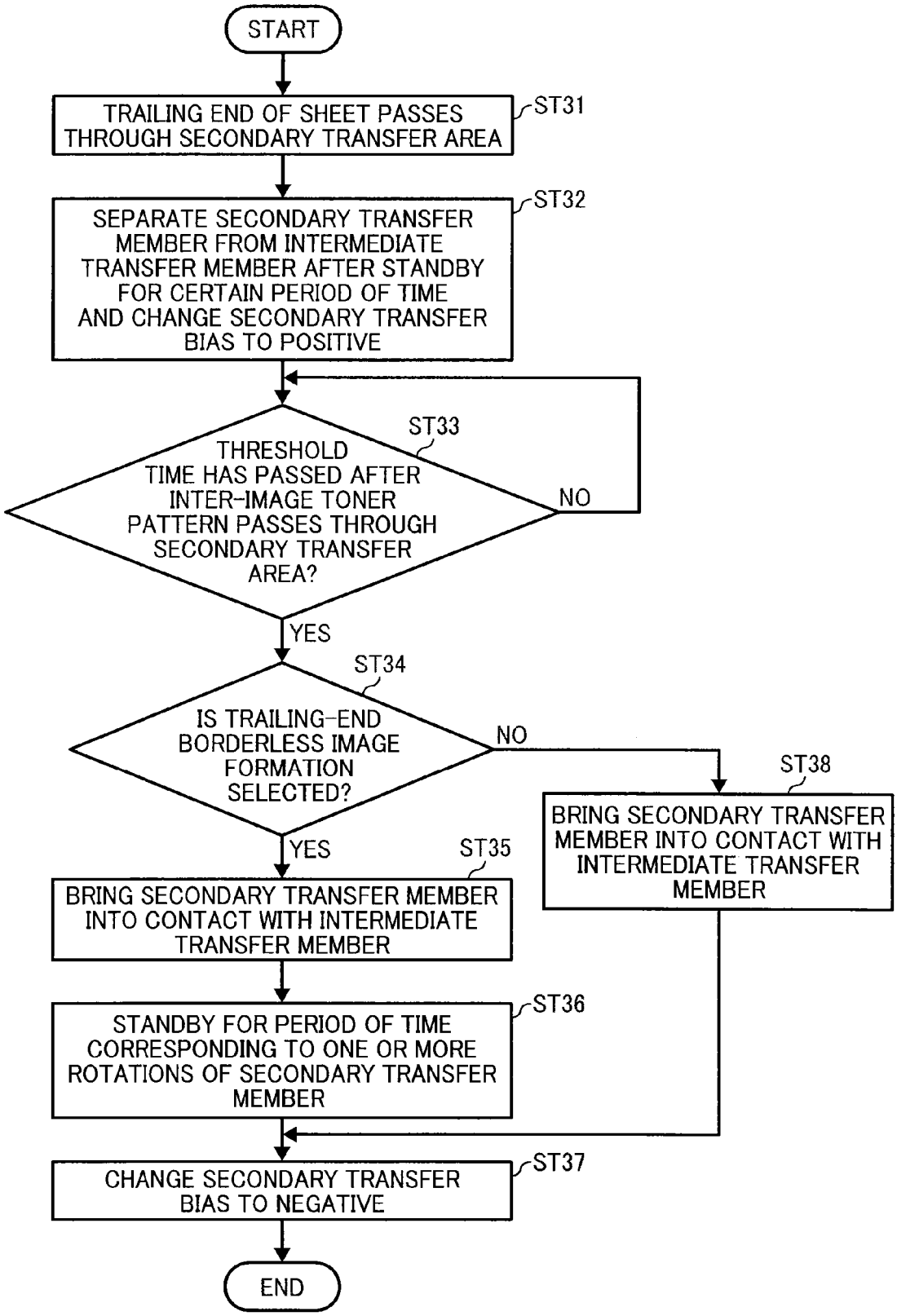
FIG. 13 is a flow chart of an image forming operation in a fifth exemplary embodiment of the present disclosure.

Next, a fifth exemplary embodiment of the present disclosure is described with reference to a flow chart shown in FIG. 13.

The fifth exemplary embodiment employs a configuration in which a distance between sheets is increased corresponding to one rotation of a secondary transfer roller 7 or more as compared with normal image information in the case in which trailing-end-borderless image formation is carried out. In the present exemplary embodiment, the distance is increased corresponding to 1.2 rotations.

First of all, a trailing end of a sheet passes through a secondary transfer device 22 (ST31), a secondary transfer contact-and-separation assembly 6 is then operated after a standby for a certain interval irrespective of whether or not the trailing-end-borderless image formation is carried out so that the secondary transfer roller 7 is separated from an intermediate transfer belt 10. Thereafter, a secondary transfer bias is switched into a positive bias that is a reverse polarity to that in the image formation (ST32). When an operation for separating the secondary transfer roller 7 is carried out immediately behind the trailing end of the sheet, the secondary transfer roller 7 may be separated in a state in which the sheet is still present in the secondary transfer device 22 depending on a variation in a sheet conveyance timing in some cases. In these cases, there is a fear that an image failure might occur. In the present exemplary embodiment, therefore, there is employed the configuration in which an interval is left by a certain distance.

When a toner pattern (a toner patch) formed between images passes through the secondary transfer device 22 and a certain period of time passes (ST33), it is determined whether the trailing-end-borderless image formation is selected or not (ST34). When the trailing-end-borderless image formation is selected, the secondary transfer contact-and-separation assembly 6 is operated to start a contacting operation of the secondary transfer roller 7 on the intermediate transfer belt 10 (ST35). Then, an operation of an image forming unit is continuously carried out corresponding to 1.2 rotations of the secondary transfer roller 7 after starting the contacting operation (ST36), and a secondary transfer bias is subsequently switched into a negative bias for image formation (ST37) and the operation is then ended. When the (trailing-end-borderless image formation is not selected at step ST34, the contacting operation of the secondary transfer roller 7 on the intermediate transfer belt 10 is started (ST38) and a transition to step ST37 is then made.

Figure 14:
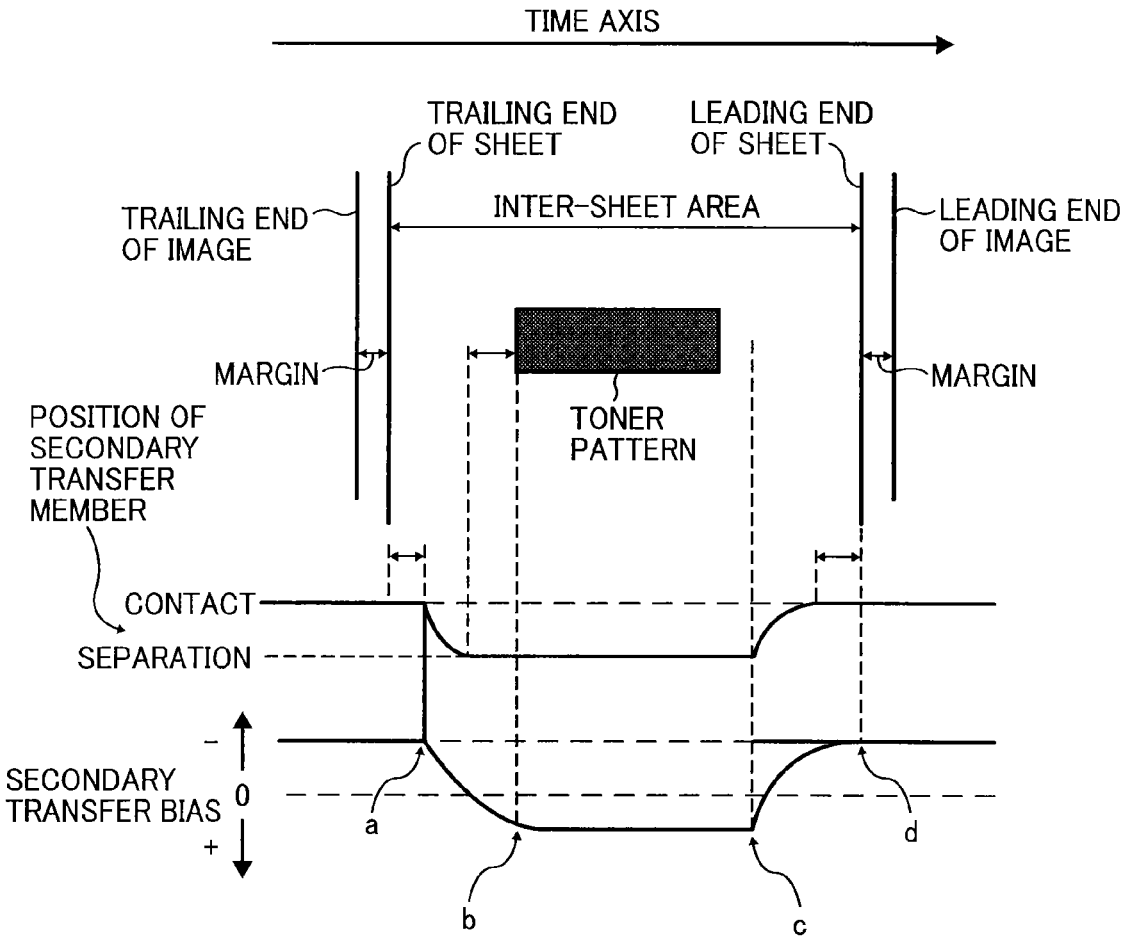
FIG. 14 is a schematic diagram of switching of a secondary transfer bias in an inter-sheet area in a case in which trailing-end-borderless image formation is not selected in the fifth embodiment of the present disclosure.
Figure 15:
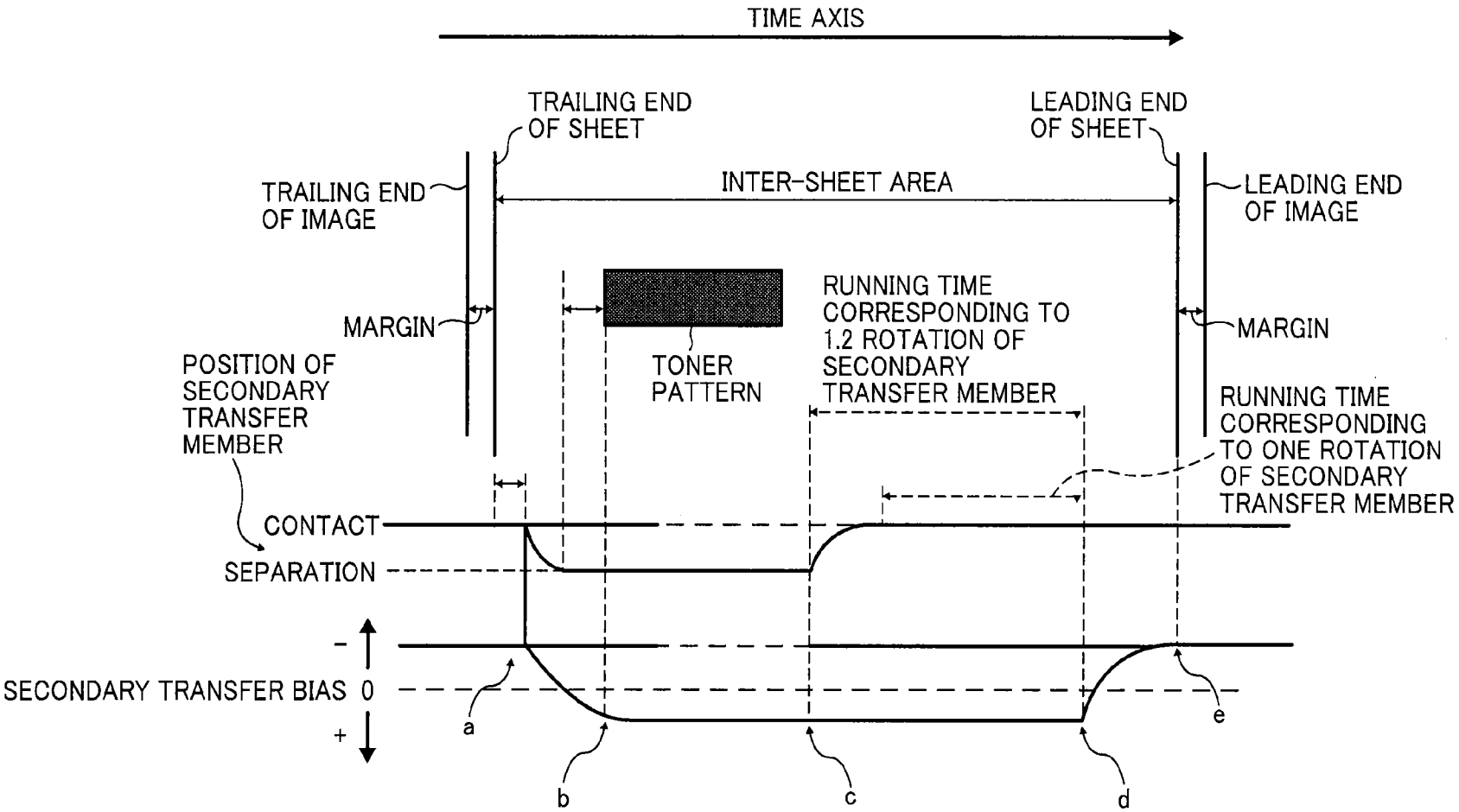
FIG. 15 is a schematic diagram of switching of a secondary transfer bias in an inter-sheet area in a case in which trailing-end-borderless image formation is selected in the fifth exemplary embodiment of the present disclosure.

In the fifth exemplary embodiment, FIG. 14 shows an example of switching of the secondary transfer bias in an inter-sheet area in the case in which the (trailing-end-borderless image formation is not selected, and FIG. 15 shows an example of switching of the secondary transfer bias in the inter-sheet area in the case in which the (trailing-end-borderless image formation is selected.

In the case in which the (trailing-end-borderless image formation is not selected as illustrated in FIG. 14, the switching of the secondary transfer bias in the secondary transfer device 22 is carried out in the following order of a to d. a. After the trailing end of the sheet passes through contact parts of the secondary transfer roller 7 and the intermediate transfer belt 10, the secondary transfer bias is switched from negative to positive. b. The switching is completed such that the secondary transfer bias is positive before a toner pattern enters the contact parts. c. After the toner pattern passes through the contact parts, the secondary transfer bias is switched from positive to negative. d. The secondary transfer bias is set to a normal output state before a leading end of a next sheet is input to the contact parts.

Moreover, in the case in which the (trailing-end-borderless image formation is selected as illustrated in FIG. 15, the switching of the secondary transfer bias in the secondary transfer device 22 is carried out in the following order of a to e. a. After the trailing end of the sheet passes through the contact parts of the secondary transfer roller 7 and the intermediate transfer belt 10, the secondary transfer bias is switched from negative to positive. b. The switching is completed such that the secondary transfer bias is positive before the toner pattern enters the contact parts. c. After the toner patch passes through the contact parts, the operation of the secondary transfer contact-and-separation assembly 6 is controlled to start the contacting operation of the secondary transfer roller 7 on the intermediate transfer belt 10. d. After the contacting operation of the secondary transfer roller 7 is started, the secondary transfer bias is switched from positive to negative after a standby for a running time corresponding to 1.2 rotations of the secondary transfer roller 7. e. The secondary transfer bias is set to a normal output state before a leading end of a next sheet is input to the contact parts.

With the above-described configuration, the switching of the secondary transfer bias after the passage of the toner pattern is delayed corresponding to the 1.2 rotations of the secondary transfer roller 7 as compared with the normal image formation. Consequently, the state in which the secondary transfer roller 7 is in contact with the intermediate transfer belt 10 and the secondary transfer bias is positive as shown in FIG. 15 is continuously maintained corresponding to one rotation of the secondary transfer roller 7. As a result, cleaning using retransfer of the toner adhering to the front face of the secondary transfer roller 7 to the intermediate transfer belt 10 can be carried out over the whole periphery of the secondary transfer roller 7. An extent of an interval between the sheets with which the cleaning can be carried out over the whole periphery of the secondary transfer roller 7 depends on a time required for the switching in the secondary transfer device 22. The interval between the sheets is set to be, for example, a period of time corresponding to at least one rotation of the secondary transfer roller 7.

In the case in which the front face of the secondary transfer roller 7 is contaminated with stray toner protruding beyond the sheet in the (trailing-end-borderless image formation, the front face of the secondary transfer roller 7 is remained contaminated when the secondary transfer roller 7 is separated from the intermediate transfer belt 10 immediately after the passage of the sheet. In the case in which the (trailing-end-borderless image formation is carried out, therefore, a distance between the sheets is increased more greatly as compared with that of the normal image formation. Consequently, it is possible to provide a time required for retransferring the toner adhering to the front face of the secondary transfer roller 7 onto the intermediate transfer belt 10 in a state in which the secondary transfer roller 7 is caused to contact the intermediate transfer belt 10. As a result, it is possible to simultaneously prevent occurrence of toner contamination caused by the borderless image formation and toner contamination caused by a toner pattern in an inter-sheet area.

With the above-described configuration, it is possible to stably maintain toner density by creating and detecting a pattern for detecting a toner adhesion amount in an inter-sheet area. Moreover, with the above-described configuration, it is possible to prevent the toner pattern formed in the inter-sheet area from adhering to the secondary transfer roller 7 by separating the secondary transfer device 22 in the inter-sheet area. Thus, it is possible to prevent occurrence of back contamination of the sheet.

With the above-described configuration, furthermore, it is possible to maintain high image quality by creating a toner discharging pattern in the inter-sheet area to replace a deteriorated toner with a new toner. Moreover, with the above-described configuration, it is possible to prevent the toner pattern formed in the inter-sheet area from adhering to the secondary transfer roller 7 by separating the secondary transfer device 22 in the inter-sheet area. Thus, it is possible to prevent the back contamination of the sheet from occurring.

With the above-described configuration, by creating a blade curling prevention pattern in the inter-sheet area, it is possible to prevent the apparatus from being stopped due to curling of a blade. With the above-described configuration, by separating the secondary transfer device 22 in the inter-sheet area, it is possible to prevent the toner pattern formed in the inter-sheet area from adhering to the secondary transfer roller 7. Thus, it is possible to prevent the occurrence of the back contamination of the sheet. The curing of a blade is likely to occur when frictional force between a cleaning target and the blade is increased. For this reason, since the frictional force is easily increased on a condition that a toner input amount is small, the curling of the blade is likely to occur. Also in this case, by periodically inputting a toner pattern to the blade in the inter-sheet area, it is possible to prevent the frictional force from being increased, thereby inhibiting the curling of the blade from occurring.

With the above-described configuration, furthermore, a color deviation detecting pattern is created in the inter-sheet area to detect color deviation, thereby adjusting an image forming position. Thus, it is possible to correct the color deviation. With the above-described configuration, by separating the secondary transfer device 22 in the inter-sheet area, it is possible to prevent the toner pattern formed in the inter-sheet area from adhering to the secondary transfer roller 7, thereby inhibiting the back contamination of the sheet from occurring. The detection and the correction of the color deviation in this case are carried out by general techniques.

Although the image forming apparatus 100 is shown as the image forming apparatus in each of the exemplary embodiments, the image forming apparatus to which the present disclosure can be applied is not restricted thereto but the present disclosure can also be applied to an image forming apparatus such as a single image forming apparatus having only one photoconductor, a printer, a plotter, a facsimile or their composite machine. Although the secondary transfer device 22 for transferring a toner image on the intermediate transfer belt 10 to a sheet has been shown as the transfer unit in each of the exemplary embodiment, the transfer unit to which the present disclosure can be applied is not restricted thereto but the present disclosure can also be applied to a transfer device for directly transferring a toner image on at least one image carrier to a sheet.

Next, an image forming apparatus according to at least one exemplary embodiment of this disclosure is described below.

Figure 18:
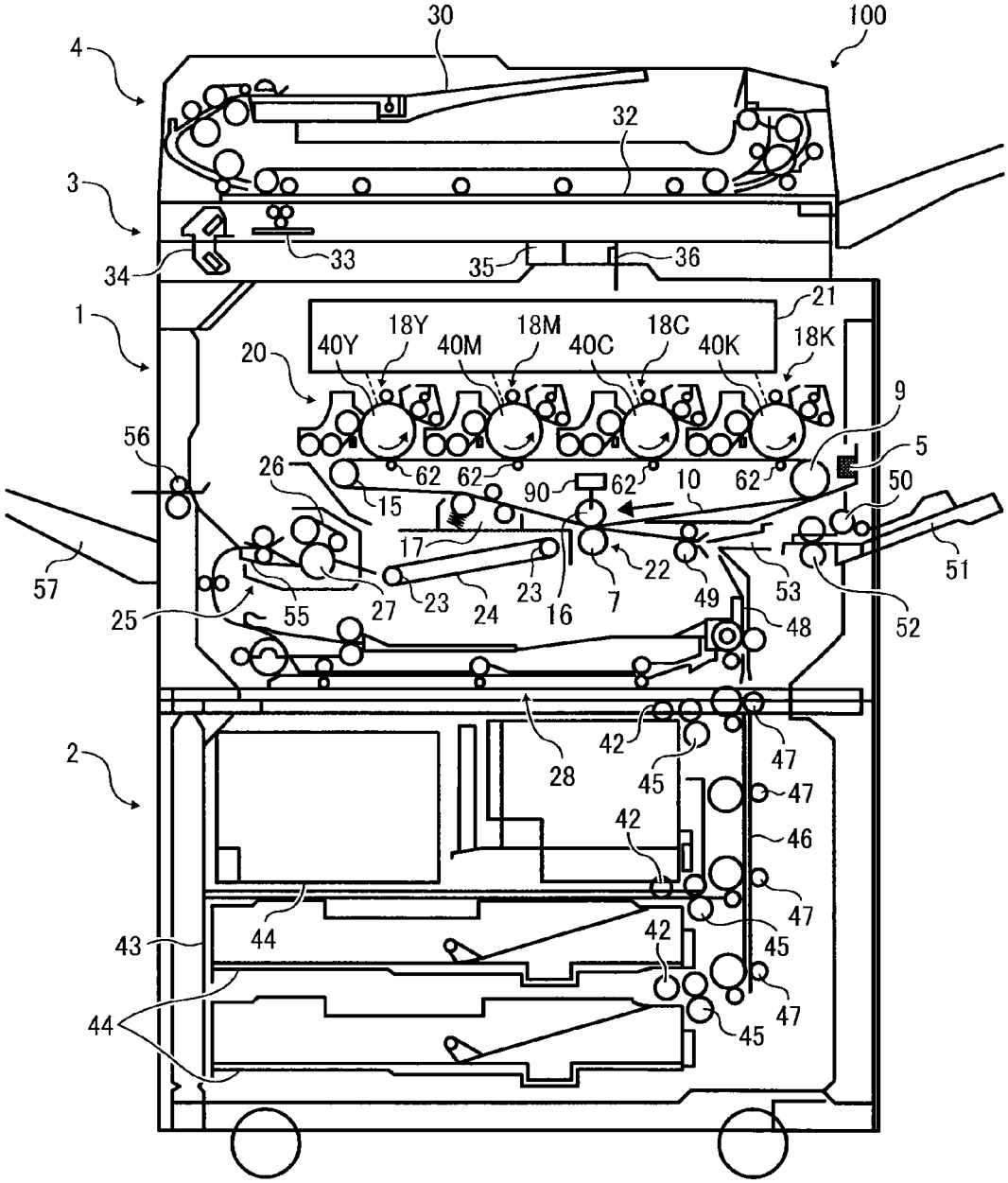
FIG. 18 is a schematic view of an image forming apparatus according to an exemplary embodiment of the present disclosure.

FIG. 18 is a view illustrating a whole configuration of an image forming apparatus 100 according to the exemplary embodiment.

A color copier (hereinafter referred to as a copier) is shown as an example of the image forming apparatus. The image forming apparatus 100 is a tandem-type electrophotographic apparatus of an intermediate transfer system using an intermediate transfer belt 10 serving as an image carrier. A sheet feed table 2 is provided in a lowermost part of the image forming apparatus 100, an apparatus body 1 is provided in an upper part thereof, and furthermore, a scanner 3 and an auto document feeder (ADF) 4 are provided in an upper part thereof.

A transfer device 20 including the endless intermediate transfer belt 10 on an almost center is provided in the apparatus body 1, and the intermediate transfer belt 10 is extendedly installed by a driving roller 9, a driven roller 15 and a secondary transfer opposed roller 16 and is rotated (is moved over a front face) in a clockwise direction in the drawing. An intermediate transfer belt cleaning device 17 is provided on a left of the driven roller 15. A toner remaining on a front face of the intermediate transfer belt 10 is removed after image transfer by the intermediate transfer belt cleaning device 17, thereby preparing for next image formation.

Four image forming units 18Y, 18M, 18C and 18K for yellow, magenta, cyan and black are provided in a front face moving direction of the intermediate transfer belt 10 above a linear part of the intermediate transfer belt 10 laid over the driving roller 9 and the driven roller 15.

Figure 19:
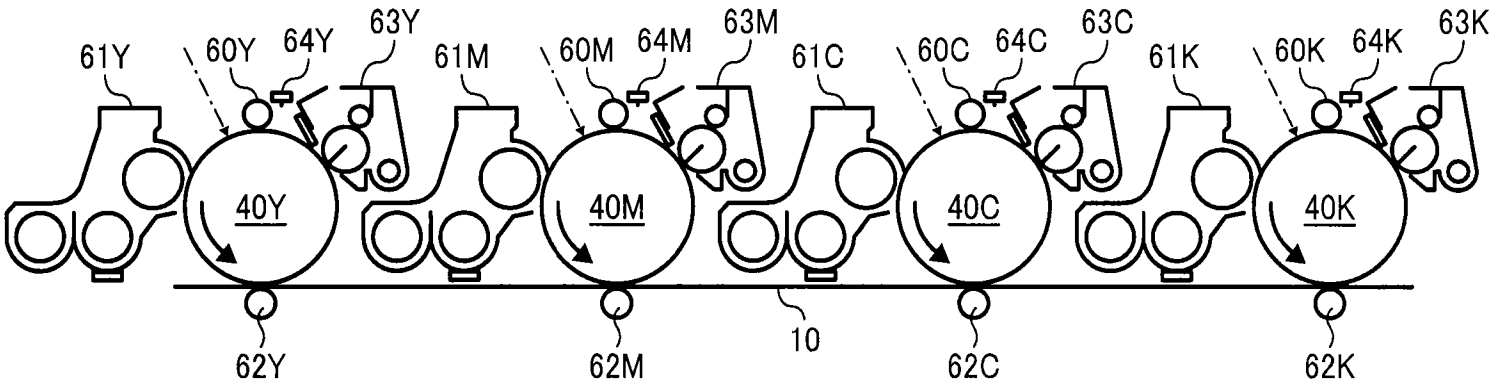
FIG. 19 is a schematic view of an image forming unit of an image forming apparatus according to at least one exemplary embodiment of the present disclosure.

FIG. 19 is an enlarged view illustrating the four image forming units 18Y, 18M, 18C and 18K and the vicinity thereof.

The respective image forming units 18Y, 18M, 18C and 18K are provided with drum-shaped photoconductors 40Y, 40M, 40C and 40K (in the case of classification, color codes Y, M, C and K will be omitted hereinafter) as latent image carriers.

The photoconductors 40 are provided rotatably in a counterclockwise direction in the drawing respectively, and a charging device 60, a development device 61, a primary transfer device 62 constituting a primary transfer unit, a photoconductor cleaning device 63 and a neutralization device 64 are provided therearound respectively. Moreover, an exposure device 21 is provided above the photoconductor 40 as illustrated in FIG. 18.

A secondary transfer device 22 is disposed below the intermediate transfer belt 10. The secondary transfer device 22 has a secondary transfer roller 7 serving as a transfer member to contact the front face of the intermediate transfer belt 10. The secondary transfer roller 7 comes into pressure contact with the secondary transfer opposed roller 16 through the intermediate transfer belt 10. The secondary transfer roller 7 and the secondary transfer opposed roller 16 form the secondary transfer device 22. A toner image on the intermediate transfer belt 10 is collectively transferred to a sheet fed into a secondary transfer area in which the secondary transfer roller 7 and the intermediate transfer belt 10 are opposed to each other.

Moreover, a transfer bias to form a transfer electric field for transferring the toner image on the intermediate transfer belt 10 to a sheet side in a secondary transfer area is applied to the secondary transfer opposed roller 16 by a secondary transfer bias applying power supply 9 serving as a transfer bias applying unit.

For the transfer of a toner image from the intermediate transfer belt 10 to a sheet through bias application, a method of applying a bias having the same polarity as a normal charging polarity of a toner from a back side of the intermediate transfer belt 10 to the secondary transfer opposed roller 16 may be employed. Moreover, a method of applying a bias having a reverse polarity to the toner from the back side of the sheet to the secondary transfer roller 7 by the secondary transfer bias applying power supply 9 may be employed.

Although the bias applying method is not restricted to either of them, a negative bias that is the same polarity as a negative polarity that is the normal charging polarity of the toner is applied to the secondary transfer opposed roller 16 by the secondary transfer bias applying power supply 9 in the present embodiment.

In the present embodiment, a foamed roller obtained by providing a foam around a metal core is used as the secondary transfer roller 7.

In the case in which a cardboard is used, a shock in collision of the secondary transfer roller 7 and the cardboard is increased more greatly in conveyance of the cardboard to the secondary transfer area with the secondary transfer roller 7 and the intermediate transfer belt 10 coming into contact with each other as compared with the case in which a thin sheet is used. There is a fear that a great vibration might be generated over the secondary transfer roller 7 by the shock and be transmitted to the photoconductor 40 or the exposure device 21 in the image forming unit 18 so that a write position for a latent image to the photoconductor 40 through the exposure device 21 might be shifted from a normal position, resulting in occurrence of an image failure.

By using the foamed roller as the secondary transfer roller 7, therefore, the shock generated in the collision of the secondary transfer roller 7 and the cardboard is relieved by the foam and the vibration generated by the shock is thus reduced so that it is possible to prevent the image failure from being caused.

A fixing device 25 is provided on a downstream side in a sheet conveyance direction of the secondary transfer roller 7. The fixing device 25 serves to fix a toner image formed on the sheet by heat and pressure through a fixing nip formed by causing a pressure roller 27 to come into pressure contact with an endless fixing belt 26. The sheet subjected to the image transfer is conveyed to the fixing nip of the fixing device 25 by an endless conveyance belt 24 stretched over a tension roller 23*a* and a tension roller 23*b*.

A sheet reverse device 28 for reversing a front face and a back face of a sheet in formation of an image on both the front face and the back face of the sheet is provided on a lower side of the secondary transfer roller 7.

When a color copy is made by the image forming apparatus 100 according to the present embodiment, a document is set onto a document table 30 of the auto document feeder 4 or the auto document feeder 4 is opened to set the document on an exposure glass 32 of the scanner 3.

When the document is set onto the exposure glass 32, the auto document feeder 4 is closed so that the document is pressed against the exposure glass 32. When a start switch is pressed down, then, the document is automatically fed onto the exposure glass 32 in the case in which the document is set onto the auto document feeder 4.

On the other hand, when the document is set onto the exposure glass 32, the scanner 3 is immediately operated so that a first scanning body 33 and a second scanning body 34 start to run. Consequently, a light emitted from a light source of the first scanning body 33 is irradiated toward the document and a light reflected from a document face is reflected in a direction toward the second scanning body 34 by a mirror of the first scanning body 33. Furthermore, the reflected light changes a direction by 180 degrees through a pair of mirrors of the second scanning body 34 and passes through an imaging lens 35, and is incident on a reading sensor 36 so that the contents of the document are read.

Moreover, the start switch is pressed down so that the intermediate transfer belt 10 starts a rotation, and at the same time, the respective photoconductors 40 also start a rotation. Consequently, respective monochromatic toner images of yellow, magenta, cyan and black are formed on the respective photoconductors 40. Thus, the respective monochromatic toner images thus formed on the photoconductors 40 are superposed on the intermediate transfer belt 10 which is being rotated in the clockwise direction in the drawing, and are thus transferred sequentially so that a synthetic color image of a full color is formed.

On the other hand, a sheet feed roller 42 provided in a sheet feed stage selected in the sheet feed table 2 is rotated so that the sheet is fed from a sheet feed cassette 44 selected in a paper bank 43 and is separated into a single piece of sheet by a separation roller 45, and is thus fed to a sheet feed passage 46. The sheet thus fed is conveyed to a sheet feed passage 48 of the apparatus body 1 by a conveyance roller 47, and contacts paired registration rollers 49 and is once brought into a stopping state.

In the case of manual sheet feed, a sheet set onto a bypass tray 51 is fed by the rotation of a bypass sheet feed roller 50, and is separated into a single piece of sheet by a bypass separation roller 52 and is thus conveyed to a bypass sheet feed passage 53, contacts the paired registration rollers 49 and is once brought into a stopping state.

In any case, the paired registration rollers 49 start a rotation in an accurate timing which is adapted to a color image on the intermediate transfer belt 10 and feed the sheet set in the stopping state into a part between the intermediate transfer belt 10 and the secondary transfer roller 7. Consequently, a color image is transferred onto the sheet from the intermediate transfer belt 10 by action of the transfer electric field generated by the transfer bias applied to the secondary transfer roller 7.

The sheet having the color image transferred thereonto is conveyed to the fixing device 25 by the conveyance belt 24 and is heated and pressurized, and the transfer image is fixed, and thereafter, the sheet is guided to an output side by a switching hook 55 and is discharged and stacked onto an output tray 57 by an output roller 56.

In the case in which a duplex copy mode is selected, the sheet having the image formed on the front face is conveyed to the sheet reverse device 28 side by the switching hook 55 and is reversed and guided to a transfer position again, and an image is formed on the back face and is then discharged onto the output tray 57 by the output roller 56.

Moreover, in the case in which a monochromatic image for black is formed on the intermediate transfer belt 10, the driven rollers 15 and 16 other than the driving roller 9 are moved to separate the photoconductors 40Y, 40M and 40C for yellow, magenta and cyan from the intermediate transfer belt 10.

In an image forming apparatus 100 of a so-called single-drum type including only one photoconductor 40 in place of the tandem type illustrated in FIG. 18, a black image is generally formed first to increase a first copy speed. Only in only the case in which a document is colored, images of the residual colors are subsequently formed.

The paired registration rollers 49 are usually grounded for use in many cases. It is also possible to apply a bias to remove paper dust of the sheet. For example, in the case in which a bias is applied by using a conductive rubber roller having a diameter of 18 mm and including a front face coated with a conductive NBR rubber in a thickness of 1 mm, a voltage may be applied in the following manner.

In other words, a volume resistance of a rubber material is approximately 109 Ωcm, and a voltage of approximately −800V is applied to a roller on a sheet face side (a front face side of the sheet) onto which the toner of the paired registration rollers 49 is transferred and a voltage of approximately □200V is applied to a roller on a back face side of the sheet.

In the intermediate transfer system, generally, the paper dust is unlikely to be moved to the photoconductor 40. For this reason, it is less necessary to take the paper dust transfer into consideration, and there is no problem even if grounding is formed. Moreover, although a DC bias is generally applied as an applied voltage, it is also possible to apply an AC voltage having a DC offset component to charge the sheet more uniformly.

Thus, the sheet front face after passing through the paired registration rollers 49 having the bias applied thereto is charged slightly negatively. For this reason, referring to the transfer to the sheet through the intermediate transfer belt 10, a transfer condition is changed or is to be altered in some cases as compared with the case in which a voltage is not applied to the registration rollers.

Figure 17:
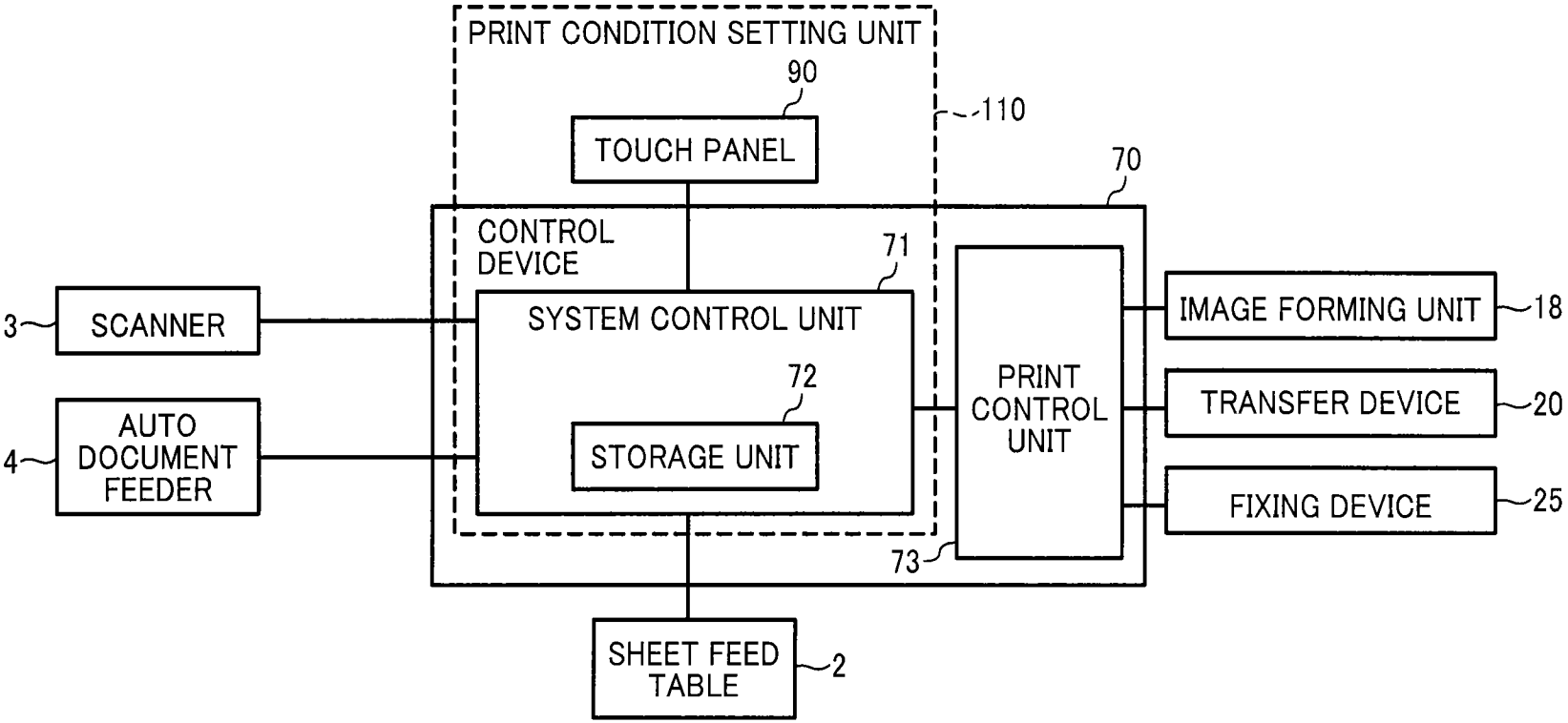
FIG. 17 is a block diagram of a control configuration of an image forming apparatus according to at least one exemplary embodiment of this disclosure.

FIG. 17 is a control block diagram of the image forming apparatus 100.

The image forming apparatus 100 according to the present embodiment is provided with a control device 70 for managing various control operations to be executed by the image forming apparatus 100 and has a system control unit 71 for controlling the whole image forming apparatus 100, for example, the sheet feed table 2, the scanner 3, the auto document feeder 4 and the like. Moreover, the control device 70 is provided with a print control unit 73, and the image forming unit 18, the transfer device 20, the fixing device 25 and the like are controlled through the print control unit 73 from the system control unit 71.

The system control unit 71 is provided with a storage unit 72, and a print condition corresponding to each type of the sheet is pre-stored therein. Moreover, an operator performs control through the system control unit 71 based on information input by the operator with the use of a touch panel 90 as an input unit, or information input by the operator can also be stored in the storage unit 72.

When the printing is started, then, the control device 70 controls the scanner 3 or the auto document feeder 4 to obtain image information, and furthermore, controls the sheet feed table 2 to feed a sheet. Moreover, a set value of the print condition corresponding to the type of the sheet is transmitted from the system control unit 71 to the print control unit 73, and the print control unit 73 controls the image forming unit 18 or the like in accordance with the set value.

The set value of the print condition corresponding to the type of the sheet may be transmitted from the system control unit 71 to the print control unit 73 based on sheet type information obtained by using the well-known sheet type discriminating method, for example, information about the type of the sheet input by the operator through the touch panel 90 or the like.

Moreover, the image forming apparatus 100 according to the present embodiment has a print condition setting unit 110 capable of setting a print condition varied for every type of a sheet, and the print condition setting unit 110 is constituted by the system control unit 71, the storage unit 72, the touch panel 90 and the like.

Figure 20A:
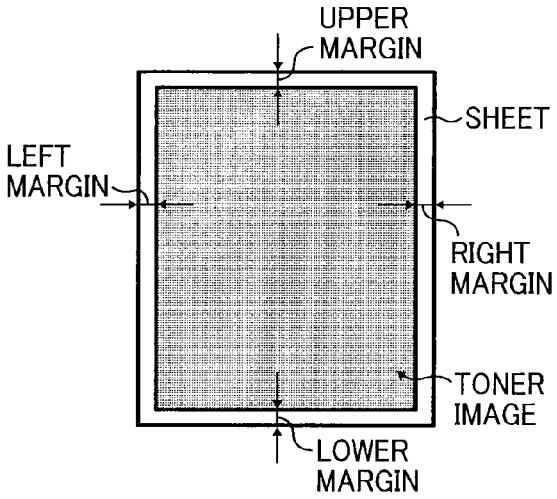
FIG. 20A is a schematic view of an example of bordered printing.
Figure 20B:
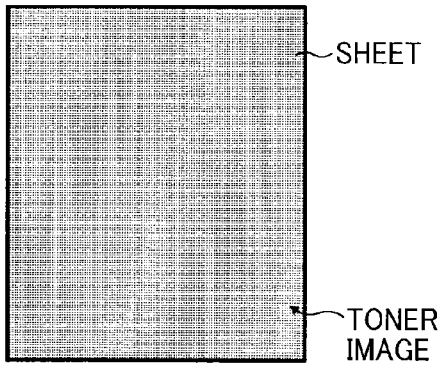
FIG. 20B is a schematic view of an example of borderless printing.
Figure 20C:
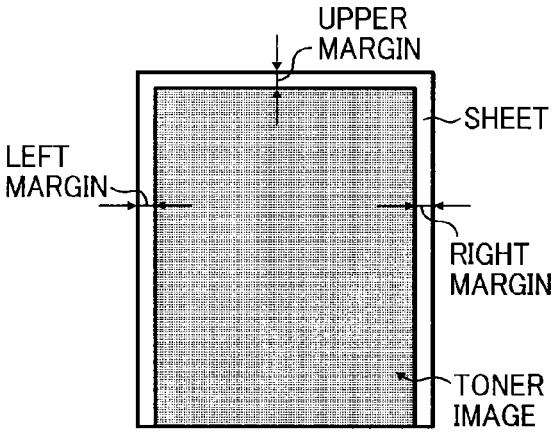
FIG. 20C is a schematic view of an example of trailing-end borderless printing.

Next, description will be given to bordered printing and borderless printing. FIG. 20A shows an example of bordered printing and FIG. 20B shows an example of borderless printing. FIG. 20C shows an example of trailing-end borderless printing.

The image forming apparatus 100 according to the present embodiment has a bordered print mode for forming a toner image on a sheet so as to have a margin on a border over a whole periphery of the sheet, and a borderless print mode for forming a toner image on the sheet so as to have no margin on any border of the sheet.

The borderless print mode is further divided into a whole-periphery-borderless print mode for forming a toner image on a sheet so as to have no margin on the border over the whole periphery of the sheet and a trailing-end borderless print mode for forming a toner image on the sheet so as to have no margin on a border at the trailing end of the sheet in a sheet conveyance direction.

In the bordered printing, the toner image formed on the intermediate transfer belt 10 is wholly included in the sheet, and margins (an upper margin, a lower margin, a left margin and a right margin) are present on the whole periphery (upper, lower, left and right parts) of the sheet as shown in FIG. 20A.

In the whole-periphery-borderless print mode, a toner image is formed on the intermediate transfer belt 10 so as to cross over the border on the whole periphery of the sheet, and the toner image is present up to the end of the sheet and the border of the whole periphery (the upper, lower, left and right parts) of the sheet has no margin as shown in FIG. 20B.

In the borderless printing, in the case in which an image is to be formed up to the end of the sheet, a toner image may be formed on the intermediate transfer belt 10 in adaptation to a position of the end of the sheet conveyed to the secondary transfer area. However, a conveyance position of the sheet entering the second transfer area is shifted considerably. For this reason, a toner image may not be formed on the intermediate transfer belt 10 so as to match the position of the end of the sheet conveyed to the secondary transfer area. Accordingly, in the image forming apparatus 100 according to the present embodiment, the toner image is formed on the intermediate transfer belt 10 so as to cross over the border of the sheet.

In the trailing-end borderless printing, a toner image is formed on the intermediate transfer belt 10 in such a manner that the toner image crosses over the trailing end (a lower end of the sheet in FIG. 20C) in the sheet conveyance direction of the sheet and does not cross over the other ends (upper, left and right ends in FIG. 20C) of the sheet. In other words, as illustrated in FIG. 20C, the toner image is present up to the lower end of the sheet (the trailing end of the sheet), the lower end of the sheet has no margin (the lower margin), and the margins (the upper, left and right margins) are present on the other ends of the sheet.

A method of controlling an image forming apparatus related to image formation in the borderless printing is well known and the present disclosure does not restrict the method of controlling the borderless printing. For this reason, description of the example of the controlling method will be omitted.

Figure 21:
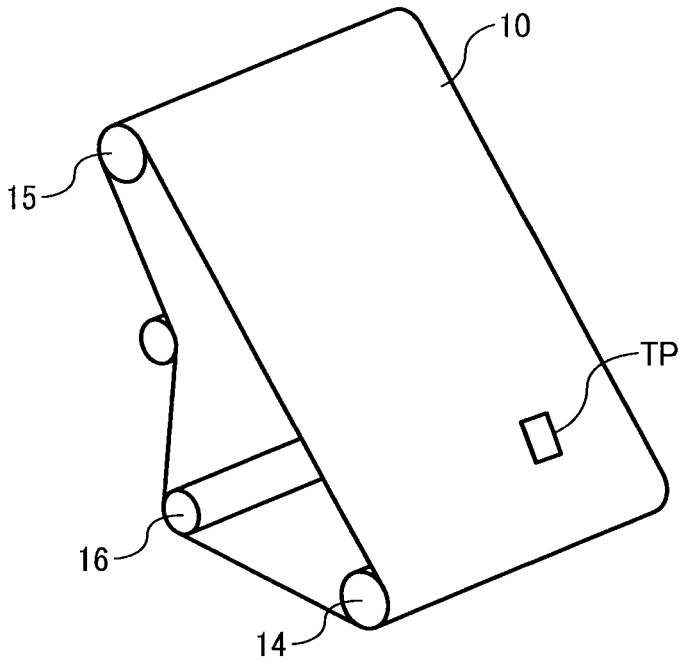
FIG. 21 is a schematic view of an intermediate transfer belt in a state in which a toner pattern for density adjustment control is formed on the intermediate transfer belt.

FIG. 21 illustrates a state in which a toner pattern TP for density adjustment control constituted by plural types of density detecting toner patterns is formed on the intermediate transfer belt 10. The toner pattern TP of which image is formed on the photoconductor 40 is transferred onto the intermediate transfer belt 10 by the primary transfer device 62 and is maintained to adhere onto the intermediate transfer belt 10 in a primary transfer area as a contact position of the photoconductor 40 and the intermediate transfer belt 10.

The toner pattern TP for density adjustment control usually has a plurality of toner patterns formed thereon in such a manner that target densities are different from each other for respective colors, and a toner adhesion amount (a toner density) of each toner pattern is detected by a toner adhesion amount sensor 5 attached opposite to the intermediate transfer belt 10.

A work for detecting the toner adhesion amount through the toner pattern TP is carried out in the following two timings. In other words, the detecting work is executed in a separate process control mode from an image forming operation (a density adjustment control mode) or is carried out by utilizing an inter-sheet area (an inter-toner image area) on the intermediate transfer belt 10 for a continuous image formation period (during continuous printing). In particular, it is desirable that the detecting work should be executed by utilizing the inter-sheet area on the intermediate transfer belt 10 for the continuous image formation period when the bordered print mode is executed.

The toner pattern TP is subjected to imaging in the inter-sheet area by the same principle as that of an ordinary toner image. More specifically, a toner image is formed by the photoconductor 40, the charging device 60, the development device 61 and the like illustrated in FIG. 18.

Figure 22:
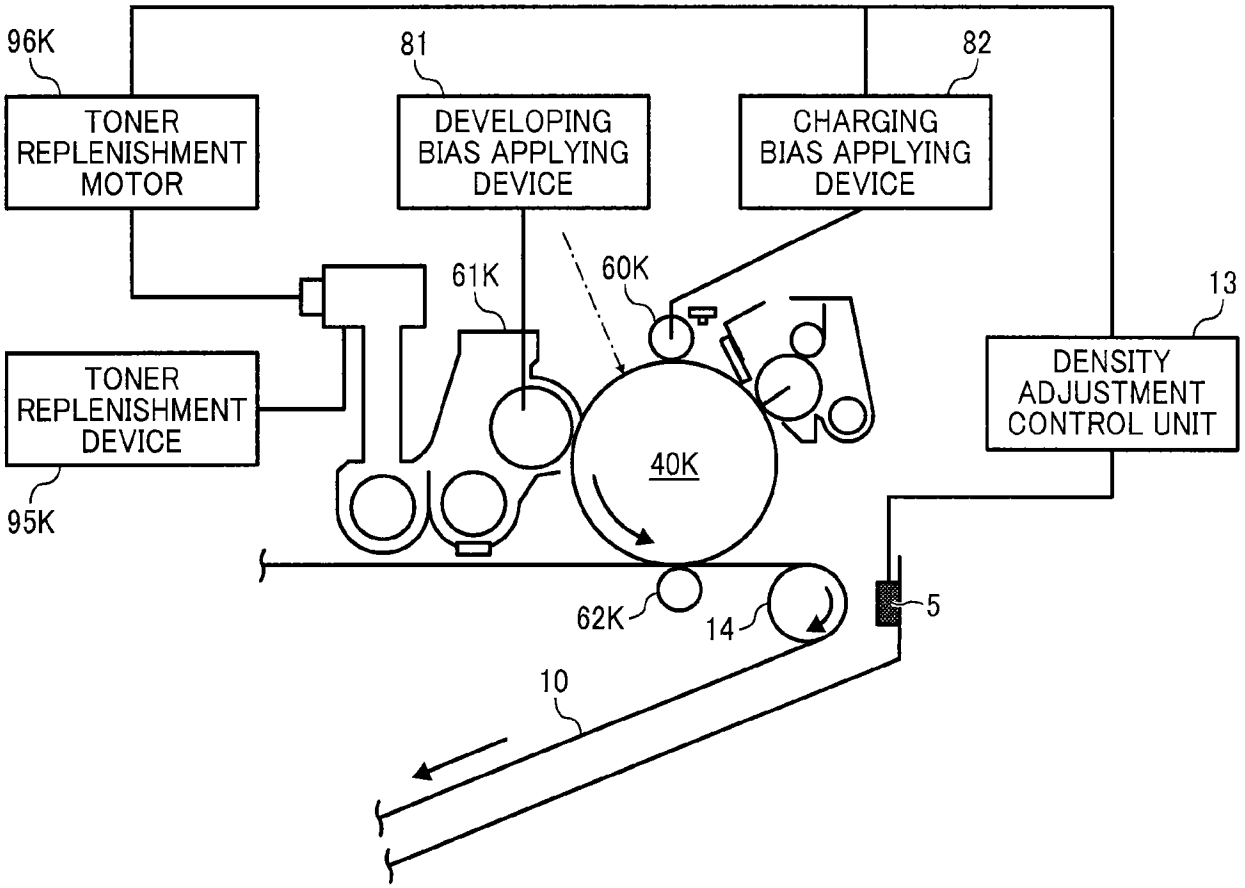
FIG. 22 is a schematic view of a toner density adjustment assembly of an image forming apparatus according to at least one exemplary embodiment of the present disclosure.

Description will be given to toner density control using the toner pattern TP. The toner adhesion amount of each of the toner patterns in the toner pattern TP is detected by the toner adhesion amount sensor 5 illustrated in FIG. 22. Based on the detected value, a density adjustment control unit 13 controls any of one or more a toner replenishment motor 96, a developing bias applying device 81 and a charging bias applying device 82 and executes the adjustment of an image density. In the case in which the adjustment is carried out by the control of the toner replenishment motor 96, the toner density is adjusted by the regulation of toner replenishment through the toner replenishment device 95, thereby adjusting an image density. In the case in which a developing bias or a charging bias is adjusted by the control of the developing bias applying device 81 or the charging bias applying device 82, the image density is adjusted depending on the regulation of a bias value. Although the description has been given with reference to FIG. 22 illustrating only the image forming unit 18K for black, actual control is carried out for all the colors.

Moreover, if an image forming operation in a low image area is carried out continuously, there is increased an old toner staying consecutively in the development device 61 for a long period of time. For this reason, a toner charging characteristic is deteriorated. If the old toner is used for the image formation, image quality is made poor (reduction in a developing capability or deterioration in a transfer characteristic). For this reason, the image forming apparatus 100 according to the present embodiment includes a refresh mode for refreshing the toner in the development device 61. In the refresh mode, the toner is discharged to an inter-sheet area on the photoconductor 40 at a certain timing in such a manner that the old toner does not stay in the development device 61, a new toner is replenished to the development device 61 after the discharge of the toner, and the toner in the development device 61 is thus refreshed.

A control unit stores toner consumption amounts of the development devices 61Y, 61M, 61C and 61K and operation times of the development devices 61Y, 61M, 61C and 61K. For the respective development devices 61, it is checked whether or not the toner consumption amount is equal to or smaller than a threshold with respect to an operation time for a predetermined period of the development device 61 at a predetermined timing. Then, the refresh mode is executed for the development device 61 in which the toner consumption amount is equal to or smaller than the threshold.

When the refresh mode is executed, a toner consumption pattern is formed in the inter-sheet area on the photoconductor 40 and is transferred to the intermediate transfer belt 10. An adhesion amount of the toner consumption pattern is determined based on the toner consumption amount with respect to the operation time for the predetermined period of the development device 61, and a maximum adhesion amount per unit area reaches approximately 1.0 mg/cm$^2$ in some cases. Moreover, in the case in which a toner Q/d distribution of the toner consumption pattern transferred to the intermediate transfer belt 10 is measured, it is apparent that the toner Q/d distribution is almost matched with a normal charging polarity.

Furthermore, the toner consumption pattern formed in the inter-sheet area on the photoconductor 40 is transferred to the inter-sheet area of the intermediate transfer belt 10 and is removed from the intermediate transfer belt 10 by the intermediate transfer belt cleaning device 17.

Figure 23A:
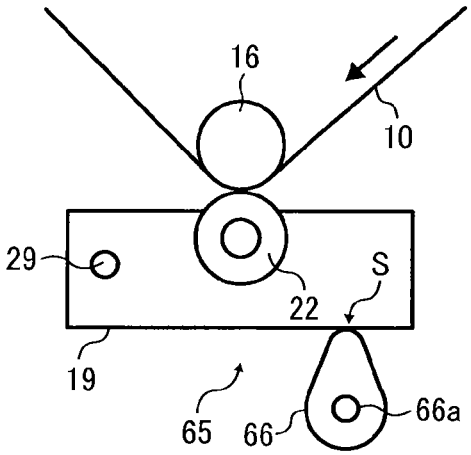
FIG. 23A is a schematic view of a contact state of a secondary transfer roller and an intermediate transfer belt.
Figure 23B:
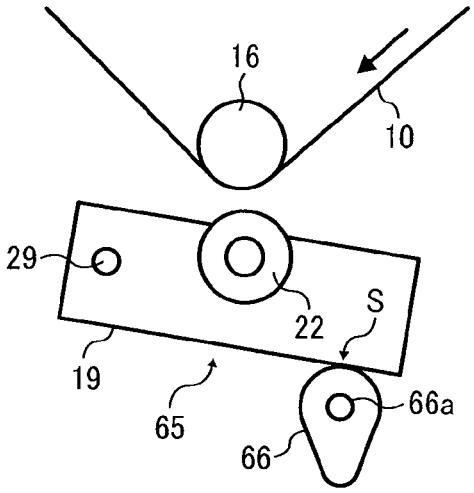
FIG. 23B is a schematic view of a separation state of a secondary transfer roller and an intermediate transfer belt.

FIGS. 23A and 23B are pattern diagrams for explaining a configuration and an operation of a secondary transfer contact-and-separation assembly 65 for separating the secondary transfer roller 7 from the intermediate transfer belt 10. FIG. 23A is a view in the case in which the secondary transfer roller 7 and the intermediate transfer belt 10 are set into a contact state and FIG. 23B is a view in the case in which the secondary transfer roller 7 and the intermediate transfer belt 10 are set into a separation state.

The secondary transfer contact-and-separation assembly 65 has a swinging member 19 which rotatably supports a secondary transfer roller shaft 7*a* of the secondary transfer roller 7 and can carry out a swinging motion with respect to an apparatus body around a pivot shaft 29.

Moreover, the secondary transfer contact-and-separation assembly 65 has a contact-and-separation cam 66 serving as a rotatable cam member around a rotation shaft 66*a* which is disposed in such a manner that a cam face contacts a cam contact position S provided on a lower face of the swinging member 19. Furthermore, the secondary transfer contact-and-separation assembly 65 has a driving device (a contact-and-separation motor) as a rotating and driving unit for rotating the contact-and-separation cam 66.

In the present embodiment, the secondary transfer roller 7 and the intermediate transfer belt 10 are brought into a contact state as illustrated in FIG. 23A in a state in which the contact-and-separation cam 66 is rotated to a rotating position in which a cam face part that is the most distant from the rotation shaft 66*a* of the contact-and-separation cam 66 contacts a cam contact position S of the swinging member 19.

Moreover, the secondary transfer roller 7 and the intermediate transfer belt 10 are brought into a separation state as illustrated in FIG. 23B in a state in which the contact-and-separation cam 66 is rotated to a rotating position in which the closest cam face part to the rotation shaft 66*a* of the contact-and-separation cam 66 contacts the cam contact position S of the swinging member 19.

A rotating position in which the closest cam face portion to the rotation shaft 66*a* of the contact-and-separation cam 66 contacts the cam contact position S of the swinging member 19 is equivalent to a position obtained by rotating from a rotating position of FIG. 23A by 180 degrees.

When the contact-and-separation cam 66 is to be rotated from the contact state, the swinging member 19 is maintained in the contact state on the cam face of the contact-and-separation cam 66 by a dead weight. Accordingly, when the contact-and-separation cam 66 is rotated from the contact state, the swinging member 19 is rotated in a clockwise direction in the drawing around the pivot shaft 29 and the secondary transfer roller 7 is interlockingly brought into a separation state from the intermediate transfer belt 10 as shown in FIG. 23B.

For example, when the inter-sheet area having the toner pattern TP or the toner consumption pattern formed on the intermediate transfer belt 10 passes through the secondary transfer area in the bordered print mode, the secondary transfer roller 7 is separated from the intermediate transfer belt 10 by the secondary transfer contact-and-separation assembly 65. Consequently, it is possible to prevent the toner of the toner pattern TP from adhering to the front face of the secondary transfer roller 7, thereby inhibiting back face contamination or cut end contamination of the sheet or the like from occurring. Before a next sheet enters the secondary transfer area, the secondary transfer contact-and-separation assembly 65 brings the secondary transfer roller 7 into contact with the intermediate transfer belt 10.

First Exemplary embodiment In the present exemplary embodiment, a foamed roller provided with a foamed rubber as a foaming member around a metal core member is used for the secondary transfer roller 7. Although a material of the foamed rubber is not particularly restricted, the NBR rubber is used and an Asker C hardness measured by directly putting a harness meter on a front face of a roller of a roller member including the metal core member and the foamed member is defined and regulated into 40°.

Figure 24:
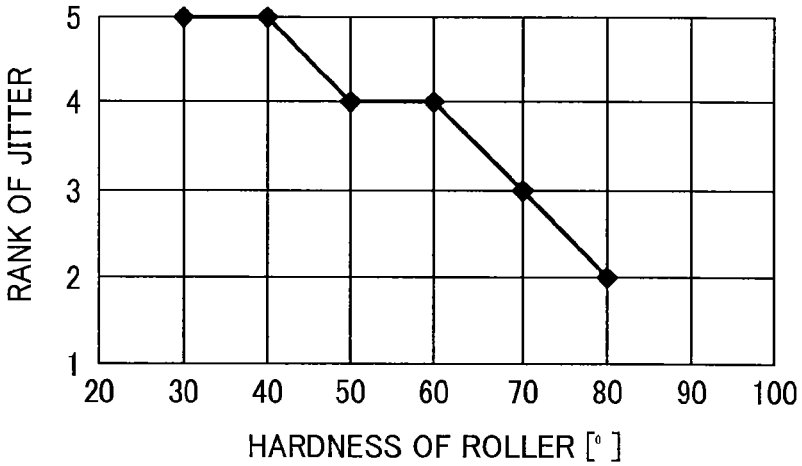
FIG. 24 is a chart of an evaluation result of a shock jitter in the first exemplary embodiment of the present disclosure.

With the above-described configuration, FIG. 24 illustrates a result obtained by evaluating a shock jitter. The evaluation is carried out in a visual observation rank of five stages. The rank 5 indicates the most excellent evaluation having no jitter, the rank 1 indicates the worst evaluation, and a permissible rank is equal to or greater than the rank 4. An evaluation sheet is set to be a cardboard having a basis weight of 300 g/m$^2$. To evaluate influence on primary transfer, development and write in feed of the sheet, there is evaluated the worst jitter caused by continuous passage of ten evaluation sheets.

Moreover, in addition to the foamed roller having the Asker C hardness of 40° according to the exemplary embodiment, foamed rollers having an Asker C hardness of 70°, 60°, 50° or 30° and a solid rubber roller having an Asker C hardness of 80° are also used for comparison, as the secondary transfer roller 7.

From FIG. 24, it is apparent that the jitter is unlikely to be caused when the secondary transfer roller 7 has a lower hardness, and the jitter is within a permissible range when the Asker C hardness is equal to or smaller than 60°. Furthermore, the jitter is improved so as not to be visually seen when the Asker C hardness is equal to or smaller than 40°.

However, pressure is applied repetitively when the roller hardness is reduced, and the roller is thus likely to be deformed. For this reason, it is not desirable that the roller hardness should be reduced unnecessarily.

Moreover, in the present embodiment, there is provided the print condition setting unit 110 capable of setting a print condition varied for every type of a sheet. It is possible to select whether the trailing-end borderless printing is to be carried out or not by the print condition setting unit 110.

Consequently, it is possible to select whether or not the trailing-end borderless printing is to be carried out more simply as compared with the case in which the operator selects the bordered print mode or the trailing-end borderless print mode in the setting of the print condition at every time of printing.

Next, description will be given to the print condition setting unit 110 capable of setting a print condition varied for every type of a sheet.

As a conventional art, there has been proposed an image forming apparatus capable of properly carrying out image formation for sheets having various types of sheet qualities and sizes (JP-2010-217742-A or the like). The image forming apparatus 100 according to the present embodiment employs the conventional art, and an operator can set a custom sheet type in addition to a previously registered sheet type (a preset sheet type).

More specifically, the operator inputs, as a custom set parameter, a value of a parameter such as a transfer bias or a fixing temperature of image formation parameters through the touch panel 90 provided in the image forming apparatus 100. A set of the custom set parameters thus input is assumed to be a custom sheet type set value and is stored as a print condition in a storage unit 72 provided in the system control unit 71 for controlling the whole image forming apparatus 100. When the printing is started, the custom sheet type set value is transmitted from the system control unit 71 to the print control unit 73 for controlling the image forming unit 18 or the like and the print control unit 73 controls the image forming unit 18 or the like in accordance with the value of each parameter of the custom sheet type set value.

Moreover, in the image forming apparatus 100 according to the present embodiment, among the borderless printings, at least whether or not the trailing-end borderless printing is to be carried out can be selected as one of custom sheet type setting operations for setting the print condition by the print condition setting unit 110. In detail, the operator can select for every type of sheet, through the touch panel 90, whether the bordered print mode is to be executed or the trailing-end borderless print mode is to be executed, and can preset the selection as the print condition and can store the print condition in the storage unit 72 of the system control unit 71.

Consequently, the operator can optionally preset the trailing-end borderless print mode as the print condition for a sheet of a type to which the trailing-end borderless printing is to be carried out, and can preset the bordered print mode as the print condition for a sheet of a type to which the trailing-end borderless printing is not to be carried out.

Accordingly, the operator can decide whether or not the trailing-end borderless print mode is to be set for every type of the sheet without selecting the bordered print mode or the trailing-end borderless print mode at every time of printing, and the printing can be carried out with the bordered print mode or the trailing-end borderless print mode automatically selected.

Therefore, it is possible to be selected whether or not the trailing-end borderless print mode is to be carried out for every sheet type, thereby carrying out the printing while preventing the operation of the operator from being complicated. Moreover, when a sheet of a type to which the trailing-end borderless printing is to be carried out or a sheet of a type to which the bordered printing is to be carried out is used, it is also possible to prevent the printing from being performed in a state in which the operator forgets to select the trailing-end borderless print mode or the bordered print mode.

Although it is possible to select the bordered print mode or the trailing-end borderless mode for every sheet type as the print condition in the above, the present disclosure is not restricted thereto. In other words, it may be also possible to select the bordered print mode or the whole-periphery-borderless print mode or to select the bordered print mode, the whole-periphery-borderless print mode or the trailing-end borderless print mode, as the print condition for every sheet type.

Moreover, referring to the fact that the operator selects whether the bordered printing or the borderless printing is to be carried out for every sheet type by the print condition setting unit 110 and then presets the selection as the print condition, the present disclosure is not restricted to an image forming apparatus using an electrophotographic system. In other words, the present disclosure can also be applied to an image forming apparatus using another system, for example, an image forming apparatus using an ink jet system or the like.

Figure 25:
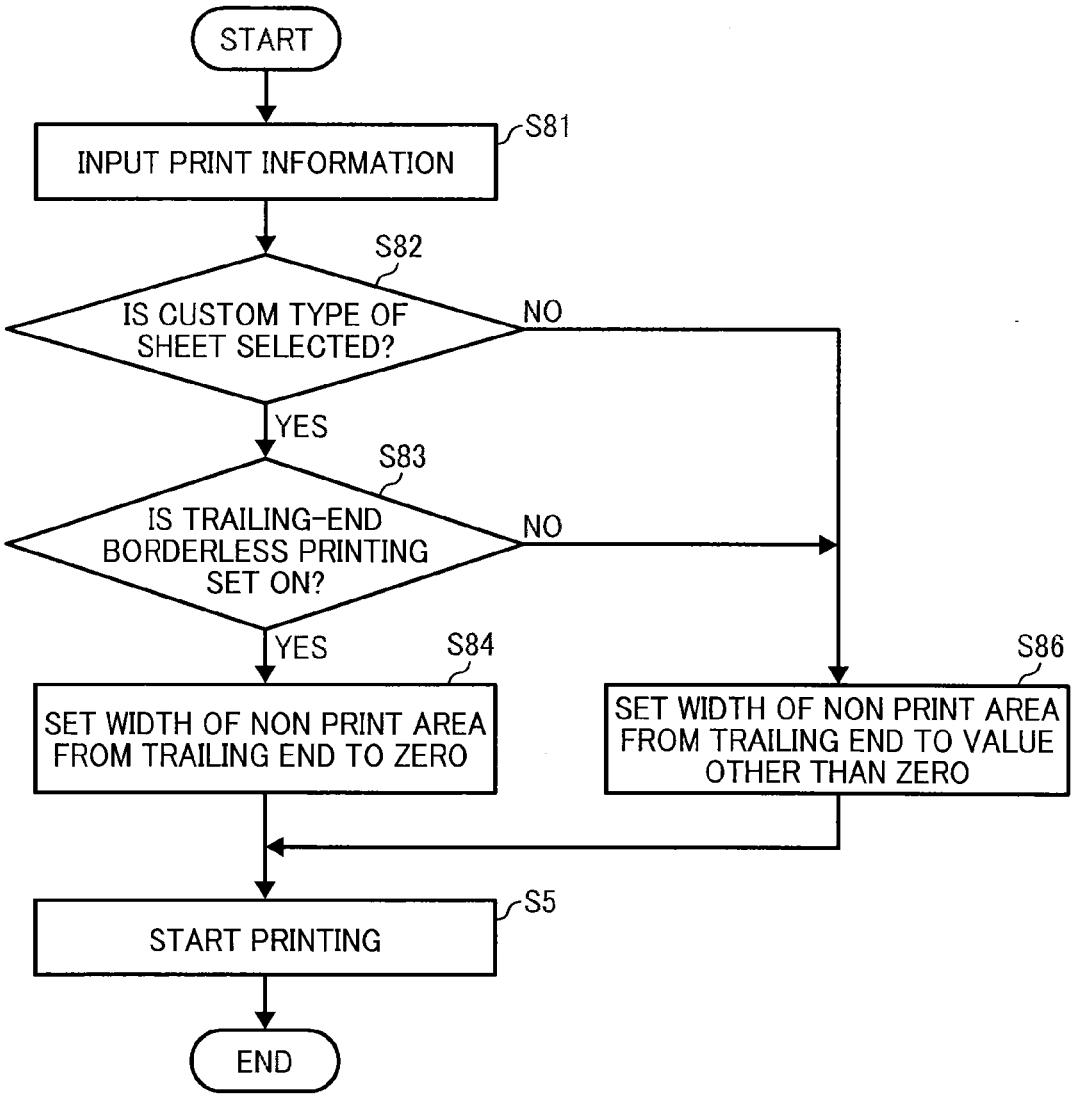
FIG. 25 is a flow chart of control of trailing-end borderless printing.

FIG. 25 is a flow chart illustrating printing operation control in the case in which whether or not the trailing end borderless printing is to be carried out is selected as the print condition for every sheet type by the print condition setting unit 110.

First of all, print information is input (S1) and it is determined whether a custom sheet type is selected or not for sheet type setting in the print information (S2). When the custom sheet type is selected (YES in S2), it is determined whether the "trailing-end borderless printing" is set or not in the sheet type setting of the custom sheet type (S3). When the setting of the "trailing-end borderless printing" is "ON" (YES in S3), a width of a non-print area from a trailing end in an image formation area is set to be zero (S4) and the printing is started in the width of the non-print area from the trailing end thus set (S5). Then, serial control is ended.

In general, a value other than zero is usually set to be the width of the non-print area from the trailing end. Even if image information is included in a full sheet size, an image on a sheet end is cut into a certain area to carry out the image formation to prevent the sheet from being caught at fixing or back contamination. On the other hand, when the width of the non-print area from the trailing end is set to be zero, the image formation is fully carried out up to the sheet end when the image information is included in the full sheet size.

When the custom sheet type is not selected (NO in S2) or the set of the "trailing end borderless printing" is "OFF" (NO in S3), the width of the non-print area from the trailing end in the image formation area is set to be a preset normal value (a predetermined value) other than zero (S6). In other words, even if the image information is included in the full sheet size, an image on a sheet end is cut into a certain area to carry out the image formation to prevent the sheet from being caught at fixing or back contamination. Thus, the printing is started with the width of the non-print area from the trailing end (S5), and the serial control is thereafter ended.

In the present embodiment, by using a foamed roller constituted by a soft material as the secondary transfer roller 7, it is possible to reduce a vibration generated when the cardboard breaks into the secondary transfer area and collides with the secondary transfer roller 7. Accordingly, it is possible to reduce the vibration transmitted to primary transfer, development and write, thereby suppressing a shock jitter.

Furthermore, it may be difficult to constantly clean the formed roller with a cleaning member such as a cleaning blade. As a result, when the borderless image formation is carried out, toner transferred outside the sheet might contaminate the front face of the secondary transfer roller 7, thus causing contamination on the back face or a cut end of the sheet after one rotation of secondary transfer roller 7. In particular, in the case in which cleaning is not always carried out, stray toner protruding beyond left and right ends of the sheet surely contaminates the cut end of the same sheet after one rotation of the secondary transfer roller.

Hence, by limiting the borderless image formation to a trailing end of the sheet, toner transferred outside the sheet in the image formation can be cleaned in the inter-sheet area, however, thus preventing occurrence of contamination on the back face or the cut end of the sheet. In some cases, however, the cleaning operation is carried out in the inter-sheet area so that productivity in continuous printing is reduced.

Therefore, it is possible to select whether or not the trailing end borderless printing is to be carried out for every type of the sheet as the print condition by the print condition setting unit 110. Consequently, it is possible to clean the inter-sheet area on the intermediate transfer belt 10 described above in only printing on a sheet of a type to which the borderless printing is to be carried out and to carry out a normal printing operation (the bordered print mode) when sheets of the other types are selected. Thus, it is possible to minimize the reduction in the productivity.

Second Exemplary embodiment In the present embodiment, there is employed a configuration in which the trailing end borderless printing is carried out and a distance in the inter-sheet area is increased by a distance corresponding to one rotation of the secondary transfer roller or more as compared with that of normal printing when the setting of "trailing end borderless printing" is "ON" in the custom sheet type setting operation. More specifically, in the present embodiment, the distance in the inter-sheet area is increased by a distance corresponding to 1.2 rotations of the secondary transfer roller as compared with that of the normal printing in the case in which the trailing-end borderless printing is carried out.

In the trailing-end borderless printing, an image is formed so as to cross over a border on the trailing end side of the sheet. For this reason, stray toner protruding beyond the border on the trailing end side of the sheet adheres onto the intermediate transfer belt 10. Therefore when an image is to be transferred from the intermediate transfer belt 10 to the sheet in the secondary transfer area, the stray toner adheres to the front face of the secondary transfer roller 7 from the intermediate transfer belt 10. Accordingly, the toner adhering to the front face of the secondary transfer roller 7 adheres to a back face or a cut end of the sheet conveyed to the secondary transfer area later. Consequently, sheet back contamination or cut end contamination is caused by the stray toner.

Therefore, the present embodiment employs a configuration in which a secondary transfer bias is switched into a bias having the same polarity as that in the normal printing and a bias having a reverse polarity thereto in the inter-sheet area and the toner adhering to the secondary transfer roller 7 is caused to adhere again to the intermediate transfer belt 10 in the inter-sheet area in the case in which the trailing-end borderless printing is carried out. When the toner adhering to the secondary transfer roller 7 is to be caused to adhere again to the intermediate transfer belt 10 in the inter-sheet area, the secondary transfer roller 7 and the intermediate transfer belt 10 are brought into contact with each other.

Figure 26:
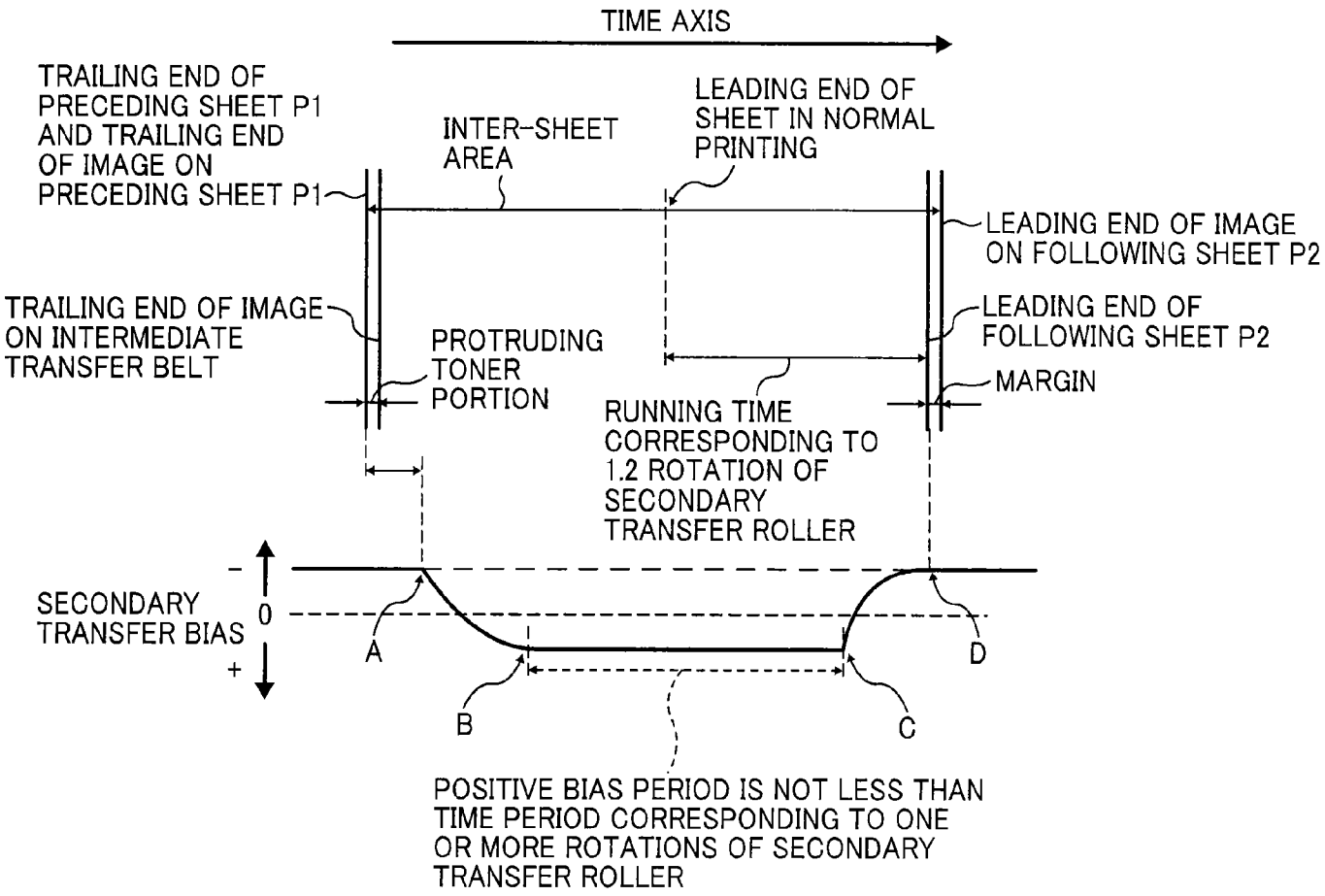
FIG. 26 is a diagram of switching control of a secondary transfer bias in an exemplary embodiment of this disclosure.

FIG. 26 is an explanatory view illustrating the control contents of secondary transfer bias switching control in the case in which the trailing-end borderless printing is set according to the present embodiment. In FIG. 26, an axis of abscissa indicates a time, and there are illustrated a timing for passage of a sheet or a toner image through the secondary transfer area and a timing for switching a secondary transfer bias through a secondary transfer bias applying power supply 9.

First of all, after a certain interval from a time point in which a trailing end of a preceding sheet P1 passes through the secondary transfer area, the secondary transfer bias is switched into a bias having a reverse polarity to that in the normal printing (a bias having a positive polarity) (a time A in FIG. 26) such that the secondary transfer bias is set to be positive (a time B in FIG. 26).

From a time point in which the trailing end of the sheet passes through the secondary transfer area, after waiting for a running time corresponding to one rotation of the secondary transfer roller or more in addition to that in the normal printing, the secondary transfer bias is switched into a bias (a bias having a negative polarity) in the normal printing (a time C in FIG. 26).

From a time point in which the trailing end of the sheet passes through the secondary transfer area, after a running time corresponding to 1.2 rotations of the secondary transfer roller or more in addition to that in the normal printing passes but before a leading end of a next following sheet P2 is input to the secondary transfer area, the secondary transfer bias is set into a state for the normal output (a time D in FIG. 26).

Thus, in the case in which the trailing-end borderless printing is carried out, a distance in the inter-sheet area is increased by a distance corresponding to 1.2 rotations of the secondary transfer roller 7 as compared with the normal printing. Consequently, it is possible to increase a time for applying a positive secondary transfer bias by a time corresponding to one rotation of the secondary transfer roller or more as compared with the normal printing. Thus, a toner having a negative polarity and adhering to the front face of the secondary transfer roller is retransferred to the intermediate transfer belt over the whole periphery of the secondary transfer roller. Consequently, it is possible to remove the toner over the whole periphery of the secondary transfer roller.

Third Exemplary embodiment In the present embodiment, there is employed a configuration in which the trailing end borderless printing is carried out and a distance in the inter-sheet area is increased by a distance corresponding to two rotations of the secondary transfer roller or more as compared with that in the normal printing when the setting of "trailing end borderless printing" is "ON" in the custom sheet type setting operation. More specifically, in the present embodiment, the distance in the inter-sheet area is increased by a distance corresponding to three rotations of the secondary transfer roller as compared with that in the normal printing in the case in which the trailing-end borderless printing is carried out.

Moreover, in the case in which the trailing-end borderless printing is carried out, a secondary transfer bias is alternately switched into a bias having the same polarity as that in the normal printing and a bias having a reverse polarity thereto in the inter-sheet area, and a toner adhering to the secondary transfer roller 7 is caused to adhere again to the intermediate transfer belt 10 in the inter-sheet area.

Figure 27:
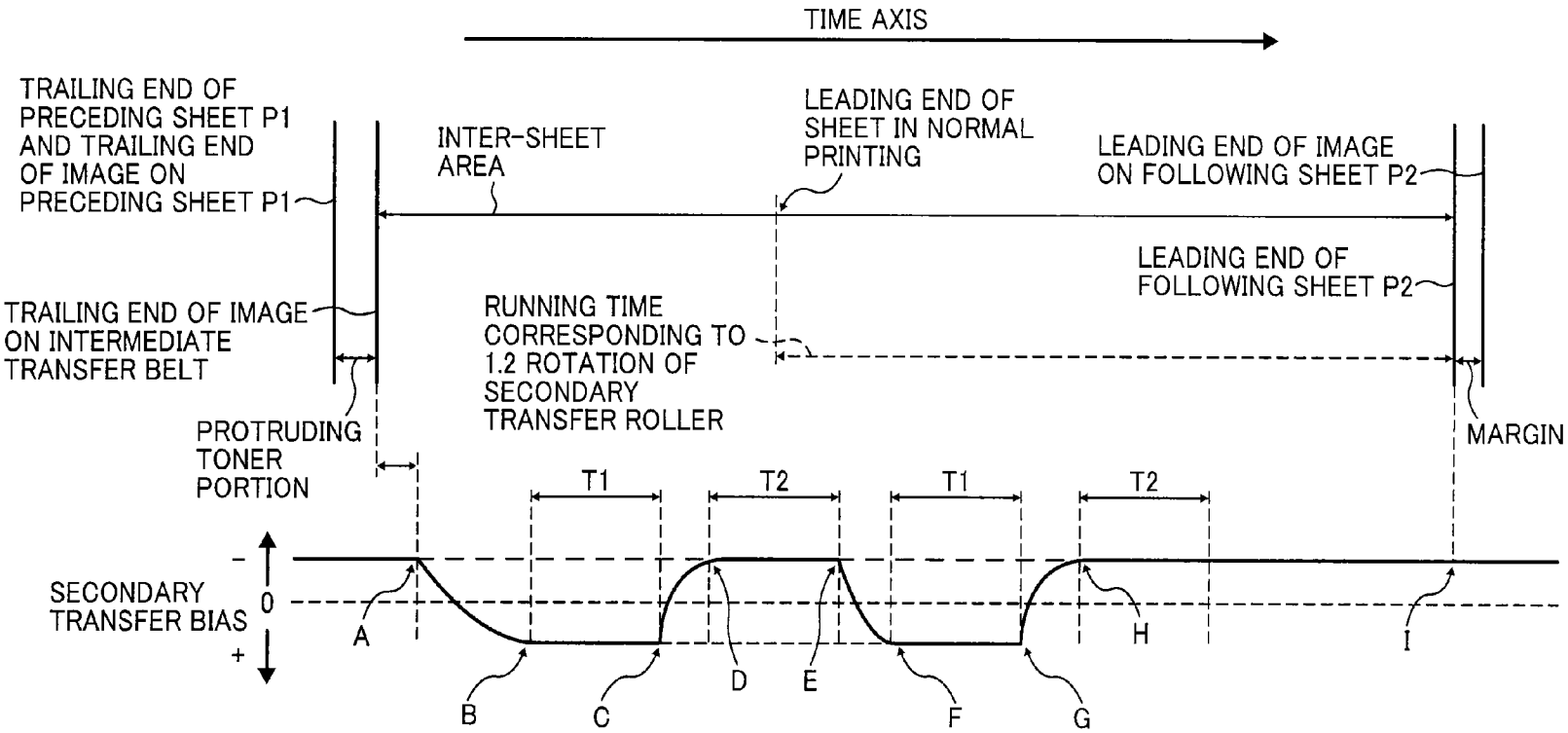
FIG. 27 is a diagram of switching control of a secondary transfer bias in an exemplary embodiment of this disclosure.

FIG. 27 is a diagram of switching control of a secondary transfer bias in a case in which the trailing-end borderless printing is set in the present embodiment. In FIG. 27, an axis of abscissa indicates a time, and there are illustrated a timing for passage of a sheet or a toner image through the secondary transfer area and a timing for switching a secondary transfer bias through the secondary transfer bias applying power supply 9.

First of all, after a certain interval from a time point in which a trailing end of a preceding sheet P 1 passes through the secondary transfer area, the secondary transfer bias is switched into a bias having a reverse polarity to that in the normal printing (a bias having a positive polarity) (a time A in FIG. 27) so that the secondary transfer bias is set to be positive (a time B in FIG. 27).

Then, after waiting for a time T1 from a time point of the bias switching, the secondary transfer bias is switched into a bias in the normal printing (a bias having a negative polarity) (a time C in FIG. 27) such that the secondary transfer bias is set to be negative (a time D in FIG. 27).

Thereafter, after waiting for a time T2 from a time point in which the secondary transfer bias is switched to be negative, the secondary transfer bias is switched into the bias having the reverse polarity to that in the normal printing (the bias having the positive polarity) (a time E in FIG. 27) such that the secondary transfer bias is set to be positive (a time F in FIG. 27).

Subsequently, after waiting for the time T1 from a time point in which the secondary transfer bias is switched to be positive, the secondary transfer bias is switched into the bias in the normal printing (the bias having the negative polarity) (a time G in FIG. 27) such that the secondary transfer bias is set to be negative (a time H in FIG. 27).

Thus, before a leading end of a next following sheet P2 is input to the secondary transfer area, the secondary transfer bias is set into a state for the normal output (a time I in FIG. 27).

As illustrated in FIG. 27, a state in which the secondary transfer bias is positive is present as a whole for a time corresponding to a time of 2□T1, and is set to correspond to at least one rotation of the secondary transfer roller. Moreover, a state in which the secondary transfer bias is negative is present as a whole for a time corresponding to a time of 2□T2, and is set to correspond to at least one rotation of the secondary transfer roller.

In the case in which the trailing-end borderless printing is carried out, a distance in the inter-sheet area is increased more greatly than that in the normal printing and the switching of the secondary transfer bias after the passage of the trailing end of the sheet through the secondary transfer area is delayed by a time corresponding to three rotations of the secondary transfer roller as compared with that in the normal printing. Consequently, it is possible to satisfy the following equations 1 and 2.

Rotating speed of secondary transfer roller× $2T1 \geq$ whole peripheral distance of secondary transfer roller (distance corresponding to one rotation) Equation 1:

Rotating speed of secondary transfer roller× $2T2 \geq$ whole peripheral distance of secondary transfer roller (distance corresponding to one rotation) Equation 2:

By satisfying the equation 1, it is possible to carry out cleaning of a negative charging toner adhering to the front face of the secondary transfer roller through retransfer to the intermediate transfer belt 10, over the whole periphery of the secondary transfer roller 7. Furthermore, by satisfying the equation 2, it is also possible to carry out cleaning of a toner charged reversely to be positive through retransfer to the intermediate transfer belt 10, over the whole periphery of the secondary transfer roller 7.

In the case in which the trailing-end borderless printing is carried out, an extent of enlargement of the inter-sheet area with which the cleaning can be performed over the whole periphery of the secondary transfer roller with respect to the normal printing performing no trailing-end borderless printing depends on a time required for the switching of the secondary transfer roller 7. However, the enlargement is set to be, for example, a period of time corresponding to at least two rotations of the secondary transfer roller as compared with the normal printing.

Moreover, although the number of times of the switching into negative and positive of the secondary transfer bias in the inter-sheet area is set to be four in total in the case in which the trailing-end borderless printing is carried out in the present embodiment, the present disclosure is not restricted thereto. In other words, in a state in which the secondary transfer roller 7 and the intermediate transfer belt 10 contact each other, it is sufficient that the negative secondary transfer bias is applied for a time corresponding to one rotation of the secondary transfer roller or more and the positive secondary transfer bias is applied for a time corresponding to one rotation of the secondary transfer roller or more. If this is satisfied, the number of times of the switching into the negative and the positive of the secondary transfer bias is not restricted.

The above description is only illustrative and the present disclosure produces peculiar effects for each following mode.

(Mode A)

An image forming apparatus such as an image forming apparatus having an image forming device such as an apparatus body 1 for forming an image on a sheet based on a preset print condition and capable of executing a bordered print mode for forming a toner image on a sheet so as to have a margin on a border around a whole periphery of the sheet and a borderless print mode for forming a toner image up to an end of a sheet so as to have no margin on the border around the whole periphery of the sheet or any border, the image forming apparatus includes a print condition setting unit such as a print condition setting unit 110 capable of setting whether the bordered print mode is executed or the borderless print mode is executed for every type of a sheet as the print condition. Consequently, an operator can select whether the bordered print mode is to be executed or the borderless print mode is to be executed for every type of a sheet by the print condition setting unit and can preset the selection as the print condition. Thus, the borderless print mode can be preset as the print condition to a sheet of such a type to which the borderless printing is to be carried out. Accordingly, in the case in which the printing is carried out by using a sheet of a type to which the borderless printing is to be always performed, the operator does not select the borderless print mode by setting the print condition at each time but the borderless print mode can be automatically selected based on the print condition, thereby performing the borderless printing. Moreover, it is possible to preset the bordered print mode as the print condition for a sheet of a type to which the bordered printing is to be carried out. Therefore, in the case in which the printing is carried out by using the sheet of a type to which the bordered printing is to be performed, the operator does not select the bordered print mode by setting the print condition at each time but the bordered print mode can be automatically selected based on the print condition, thereby performing the bordered printing. Accordingly, it is possible to select the bordered print mode or the borderless print mode for every type of a sheet, thereby carrying out the printing while preventing the operation of the operator from being complicated.

(Mode B)

In the (mode A), the image forming device includes an image carrier such as an intermediate transfer belt 10 which is provided rotatably and carries a toner image, a toner image forming unit such as an image forming unit 18 for forming a toner image on the image carrier, and a transfer unit 22 having a transfer member such as a secondary transfer roller 7 disposed to contact a front face of the image carrier and constituted rotatably, and constituted by the secondary transfer roller 7 to be the transfer member for transferring a toner image to a sheet from the image carrier, a secondary transfer opposed roller 16, a secondary transfer bias applying power supply 9 and the like. As described in the exemplary embodiment, consequently, the present disclosure can be suitably employed for an image forming apparatus using an electrophotographic system.

(Mode C)

In the (Mode B), the borderless print mode serves to carry out the trailing-end borderless printing for forming a toner image on a sheet so as to have no margin on the border at the trailing end of the sheet in a sheet conveyance direction, and a width in a rotating direction of the image carrier in an inter-sheet area present on the image carrier during a continuous image formation period in which an image is continuously formed on the image carrier is greater in the borderless print mode than in the bordered print mode. Consequently, as described in the exemplary embodiment, it is possible to remove a toner adhering to the front face of the transfer member more reliably.

(Mode D)

In the (Mode C), in the case in which the image formation is carried out in the borderless print mode, the width in the rotating direction of the image carrier in the inter-sheet area is increased by a width corresponding to a circumference of a foamed roller to be the transfer member provided in the transfer unit or more as compared with the case in which the image formation is carried out in the bordered print mode. Consequently, as described in the exemplary embodiment, the toner adhering to the transfer member can be caused to stick again to the image carrier from the front face of the foamed roller in the inter-sheet area, thereby ensuring a time required for removing the toner around the whole periphery of the foamed roller. Therefore, it is possible to prevent back contamination or cut end contamination of a sheet more reliably.

(Mode E)

In the (Mode D), in the case in which the image formation is carried out in the borderless print mode, the time in which the image carrier and the foamed roller contact each other in the inter-sheet area and in which a bias having a reverse polarity to that in the bordered print mode is applied is provided for a time corresponding to at least a time required for one rotation of the foamed roller or more. Consequently, as described in the exemplary embodiment, it is possible to remove the toner from the whole periphery of the transfer member more reliably.

(Mode F)

In the (Mode C), in the case in which the image formation is carried out in the borderless print mode, the width in the rotating direction of the image carrier in the inter-sheet area is increased by a width corresponding to at least double of the circumference of the foamed roller to be the transfer member provided in the transfer unit as compared with the case in which the image formation is carried out in the bordered print mode. Consequently, as described in the exemplary embodiment, it is possible to ensure a time required for removing the toner adhering to the foamed roller around the whole periphery of the transfer member more reliably. Thus, it is possible to prevent back contamination or cut end contamination of a sheet more reliably.

(Mode G)

In the (Mode F), in the case in which the image formation is carried out in the borderless print mode, the time in which the image carrier and the foamed roller contact each other in the inter-sheet area and in which a bias having a reverse polarity to that in the bordered print mode is applied is provided for a time corresponding to at least a time required for one rotation of the foamed roller or more, and furthermore, the time in which the image carrier and the foamed roller contact each other and in which a bias having the same polarity as that in the bordered print mode is applied is provided for a time corresponding to at least a time required for one rotation of the foamed roller or more. Consequently, as described in the exemplary embodiment, it is possible to remove the toners having a polarity the same as or reverse to a normal charging polarity of the toner from the whole periphery of the foamed roller more reliably. Thus, it is possible to prevent back contamination or cut end contamination of a sheet from occurring more reliably.

(Mode H)

In the (Mode B), (Mode C), (Mode D), (Mode E), (Mode F) or (Mode G), the transfer member is a foamed roller having an Asker C hardness of 60° or less. Consequently, as described in the exemplary embodiment, it is possible to suppress occurrence of a jitter.

(Mode I)

In the (Mode H), the foamed roller has an Asker C hardness of 45° or less. Consequently, as described in the exemplary embodiment, it is possible to improve the jitter so as not to be visually seen.

(Mode J)

In the (Mode A), (Mode B), (Mode C), (Mode D), (Mode E), (Mode F), (Mode G), (Mode H) or (Mode I), there is provided an input unit such as a touch panel 90 for inputting information about a type of a sheet by an operator, and the print condition setting unit sets a print condition for every type of a sheet based on the information about the type of the sheet which is input through the input unit. Consequently, as described in the exemplary embodiment, the operator can optionally set a suitable print condition for the type of the sheet.

(Mode K)

In the (Mode A), (Mode B), (Mode C), (Mode D), (Mode E), (Mode F), (Mode G), (Mode H), (Mode I) or (Mode J), there is provided a print mode input unit such as the touch panel 90 for inputting a print mode by an operator, and the print condition setting unit has a storage unit such as a storage unit 72 for causing the operator to select whether the bordered print mode is executed or the borderless print mode is executed for every type of a sheet through the print mode input unit, presetting and storing the selection as a print condition. Consequently, in the case in which a power supply of the apparatus is turned OFF and is then turned ON again to carry out the printing, for example, the bordered print mode can be automatically selected to perform the bordered printing by referring to the print condition stored in the storage unit. Therefore, it is possible to select the bordered print mode or the borderless print mode for every type of a sheet, thereby carrying out the printing while preventing the operation of the operator from being complicated.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image carrier having a surface to bear a toner image thereon;

a transfer unit having a transfer member to transfer the toner image onto a recording sheet conveyed in a conveyance direction for trailing-end borderless image formation and duplex image formation, the transfer unit configured to form the toner image on the recording sheet without forming a margin at a trailing end of the recording sheet in the conveyance direction in the trailing-end borderless image formation, the transfer unit configured to form the toner image on front and back faces of the recording sheet in the duplex image formation; and a control unit to, when a width of the toner image formed in a borderless image area of the recording sheet in the trailing-end borderless image formation is smaller in a direction perpendicular to the conveyance direction than a threshold value, permit the duplex image formation, and, when the width is the threshold value or greater, prohibit the duplex image formation.

2. The image forming apparatus of claim 1, wherein the control unit is configured to set a greater value as the threshold value as the toner image formed in the borderless image area has a smaller pixel area.

3. The image forming apparatus of claim 1, wherein, when a thickness of the recording sheet is not greater than a threshold value at which the duplex image formation is executable, the control unit is configured to set a greater value as the threshold value as the thickness is greater.

4. The image forming apparatus of claim 1, wherein, when a thickness of the recording sheet is not greater than a threshold value at which the duplex image formation is executable, the control unit is configured to determine the threshold value in accordance with the thickness of the recording sheet and a pixel area of the toner image formed in the borderless image area.

5. The image forming apparatus of claim 1, further comprising a contact and separation unit to separate the transfer member from the image carrier, wherein the transfer member is a foamed member, the transfer unit is configured to transfer a toner pattern in an inter-sheet area between recording sheets on the transfer member at a pattern formation mode in continuous image formation, and the contact and separation unit is configured to separate the transfer member from the image carrier when the tonner pattern formed at the pattern formation mode enters the transfer unit.

6. The image forming apparatus of claim 5, wherein the transfer member has an Asker C hardness of not greater than 60 degrees.

7. The image forming apparatus of claim 5, wherein the transfer member has an Asker C hardness of not greater than 45 degrees.

8. The image forming apparatus of claim 5, wherein the control unit is configured to set a greater distance between recording sheets in the trailing-end borderless image formation than in normal image formation.

9. The image forming apparatus of claim 8, wherein the greater distance set by the control unit corresponds to one or more rotations of the transfer member.

10. An image forming apparatus, comprising:

an image forming device to form a toner image on a recording sheet in accordance with a border print mode being one of a bordered print mode and a borderless print mode, the image forming device configured to form the toner image in the bordered print mode so that a periphery of the recording sheet is surrounded by a margin, the image forming device configured to form the toner image up to an end of the recording sheet in the borderless print mode so that at least a portion of the periphery of the recording sheet has no margin;

a print condition setting unit that presets, at a time different from a time of printing, for a type of recording sheet of a plurality of types of recording sheets, as a preset print condition, the border print mode indicating whether the bordered print mode or the borderless print mode is to be performed whenever the toner image is formed on the type of the recording sheet, wherein the print condition setting unit includes a memory that stores, as the preset print condition, the border print mode preset for the type of recording sheet; and a print mode input unit to allow an operator to input a print mode and preset, for the recording sheet, as the preset print condition, the border print mode, wherein, at the time of printing, the print condition setting unit automatically retrieves, from the memory, based on selection by the operator of the type of recording sheet, the stored border print mode previously selected by the operator using the print mode input unit, and sets the border print mode to the retrieved border print mode, without the operator selecting the border print mode at the time of printing.

11. The image forming apparatus of claim 10, wherein the image forming unit has an image carrier rotatably provided to bear a toner image, an image forming unit to form the toner image on the image carrier, and a transfer unit to transfer the toner image from the image carrier onto the recording sheet, the transfer unit having a transfer member rotatably disposed to contact a surface of the image carrier.

12. The image forming apparatus of claim 11, wherein the image forming device is configured to form the toner image on the recording sheet so that the recording sheet has no margin on a trailing edge of the recording sheet in a conveyance direction of the recording sheet in the borderless print mode, the image forming device is configured to continuously form toner images on the image carrier in continuous image formation, and an inter-sheet area between recording sheets on the image carrier during the continuous image formation is configured to have a greater width in a rotation direction of the image carrier in the borderless print mode than in the bordered print mode.

13. The image forming apparatus of claim 12, wherein the transfer member is a foamed roller, and the width of the inter-sheet area in the rotation direction of the image carrier is greater in the borderless print mode than in the bordered print mode by not less than a circumferential length of the foamed roller.

14. The image forming apparatus of claim 13, wherein, when image formation is performed in the bordered print mode, a time in which the foamed roller contacts the image carrier in the inter-sheet area and a bias having a polarity opposite a polarity in the bordered print mode is applied is set to not less than a length of time corresponding to one rotation of the foamed roller.

15. The image forming apparatus of claim 12, wherein the transfer member is formed of a foamed roller, and the width of the inter-sheet area in the rotation direction of the image carrier is greater in the borderless print mode than in the bordered print mode by not less than twice as a circumferential length of the foamed roller.

16. The image forming apparatus of claim 15, wherein, when image formation is performed in the bordered print mode, a time in which the foamed roller contacts the image carrier in the inter-sheet area and a bias having a polarity opposite a polarity in the bordered print mode is applied is set to not less than a length of time corresponding to one rotation of the foamed roller, and a time in which the foamed roller contacts the image carrier in the inter-sheet area and a bias having same polarity as the polarity in the bordered print mode is applied is set to not less than a length of time corresponding to one rotation of the foamed roller.

17. The image forming apparatus of claim 11, wherein the transfer member is a foamed roller having an Asker C hardness of not greater than 60 degrees.

18. The image forming apparatus of claim 17, wherein the transfer member is a foamed roller having an Asker C hardness of not greater than 45 degrees.

19. The image forming apparatus of claim 10, further comprising an input unit to allow an operator to input information on the type of the recording sheet, wherein the print condition setting unit is configured to set the preset print conditions based on the information input through the input unit.

* * * * *